United States Patent [19]

Tomita et al.

[11] 4,267,204

[45] May 12, 1981

[54] METHOD OF MANUFACTURING STRIPED PHOSPHOR SCREEN FOR BLACK MATRIX TYPE COLOR PICTURE TUBE

[75] Inventors: Yoshifumi Tomita; Masahiro Nishizawa; Takashi Fujimura, all of Mobara, Japan

[73] Assignee: Hitachi, Ltd., Tokyo, Japan

[21] Appl. No.: 959,151

[22] Filed: Nov. 9, 1978

[51] Int. Cl.[3] ..... H01J 29/32

[52] U.S. Cl. ..... 427/68; 427/8

[58] Field of Search ..... 427/68, 8

[56] References Cited

U.S. PATENT DOCUMENTS 4,052,519 10/1977 Prazak ..... 427/68

FOREIGN PATENT DOCUMENTS 52-134368 11/1977 Japan .

578659 11/1977 U.S.S.R. ..... 427/68

*Primary Examiner*—James R. Hoffman

*Attorney, Agent, or Firm*—Craig & Antonelli

[57] ABSTRACT

In the manufacture of a striped phosphor screen for a black matrix type color picture tube, a pattern of stripes of a light-absorbing material is first formed on the faceplate of a glass envelope to define transparent striped windows thereon by a known process and then phosphor materials are applied to the striped windows by the use of a nozzle assembly having at least one nozzle capable of discharging a phosphor material, without owing to the photolighography. The coating apparatus comprises a nozzle assembly including one or more nozzles, drivers for effecting relative movement between the nozzle and the faceplate of the glass envelope in a first direction in the plane of the faceplate and perpendicular to the stripes, in a third direction perpendicular to the faceplate and in a second direction longitudinal of the stripes, sensors for detecting the position of the nozzle, generators for producing a positional error signal and control for controlling the position of the nozzle.

6 Claims, 31 Drawing Figures

IIA
IIA
9
11
13
8
b'
2'
Px1
d'
L
a
b
c'
c
10a
12a
12
11
Ox1
2
8

METHOD OF MANUFACTURING STRIPED PHOSPHOR SCREEN FOR BLACK MATRIX TYPE COLOR PICTURE TUBE

BACKGROUND OF THE INVENTION

The present invention relates to a method for manufacturing a striped phosphor screen for a black matrix type color picture tube and an apparatus for coating phosphor material in a stripe pattern.

When a phosphor screen of a color picture tube is formed, a method has been usually used, in which grains of a phosphor material are suspended in a photosensitive solution containing an aqueous solution of a mixture of polyvinyl alcohol and ammonium bichromate to prepare a slurry, which is then uniformly applied on the inner surface of a panel of the color picture tube, and the applied slurry is exposed through a shadow mask to render only the exposed areas insoluble, and the slurry is developed to leave a desired picture element pattern. The above process is repeated for each of the phosphor materials of three primary colors, i.e. green, blue and red.

However, in such a prior art manufacturing method, in addition to long process time required to form each color of picture elements including slurry application, drying, exposure, development and drying, many problems occur relating to process control and facility control because the above process is repeated for each of the three primary colors. Furthermore, for a black matrix type color picture tube, it is necessary to provide a light absorbing material on those areas on the inner surface of the panel which do not correspond to the three primary colors picture elements before a phosphor pattern is formed. Since this process also needs application of a light absorbing material, exposure, development and drying, a long process time is required for both the formation of the phosphor pattern and the formation of the light absorbing pattern. Accordingly, the rationalization of workability and facilities has not been attained and hence the cost could not be reduced.

SUMMARY OF THE INVENTION

It is an object of the present invention to overcome the above problems encountered in the prior art and provide a less expensive color picture tube in substantially reducing the number of manufacturing steps in which a black matrix type striped phosphor screen is formed by directly applying phosphor materials on a faceplate of a glass envelope through the sweeping operation of a nozzle.

DESCRIPTION OF THE PREFERRED EMBODIMENTS

Figure 1:
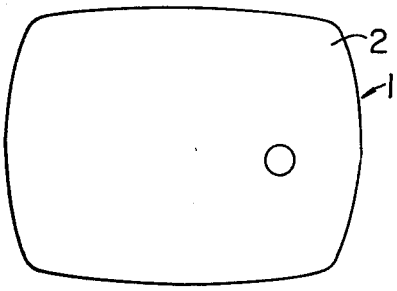
FIGS. 1 and 1A show a panel of a black matrix type color picture tube and a pattern of striped phosphor screen formed on the inner surface of the faceplate of the panel.
Figure 1A:
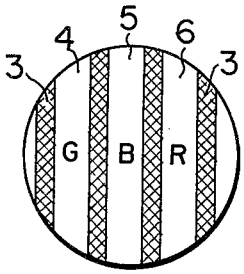

Referring to FIG. 1, a panel 1 of a black matrix type color picture tube is shown to have a faceplate 2. FIG. 1A is a magnified illustration of the circled portion of the faceplate 2. on the inner surface of which there are formed light absorbing material stripes 3 consisting of carbon, for example, and striped phosphor screen having phosphor material stripes 4, 5 and 6 of different three colors (G, B, R) each arranged between the adjacent light absorbing stripes 3.

Figure 2A:
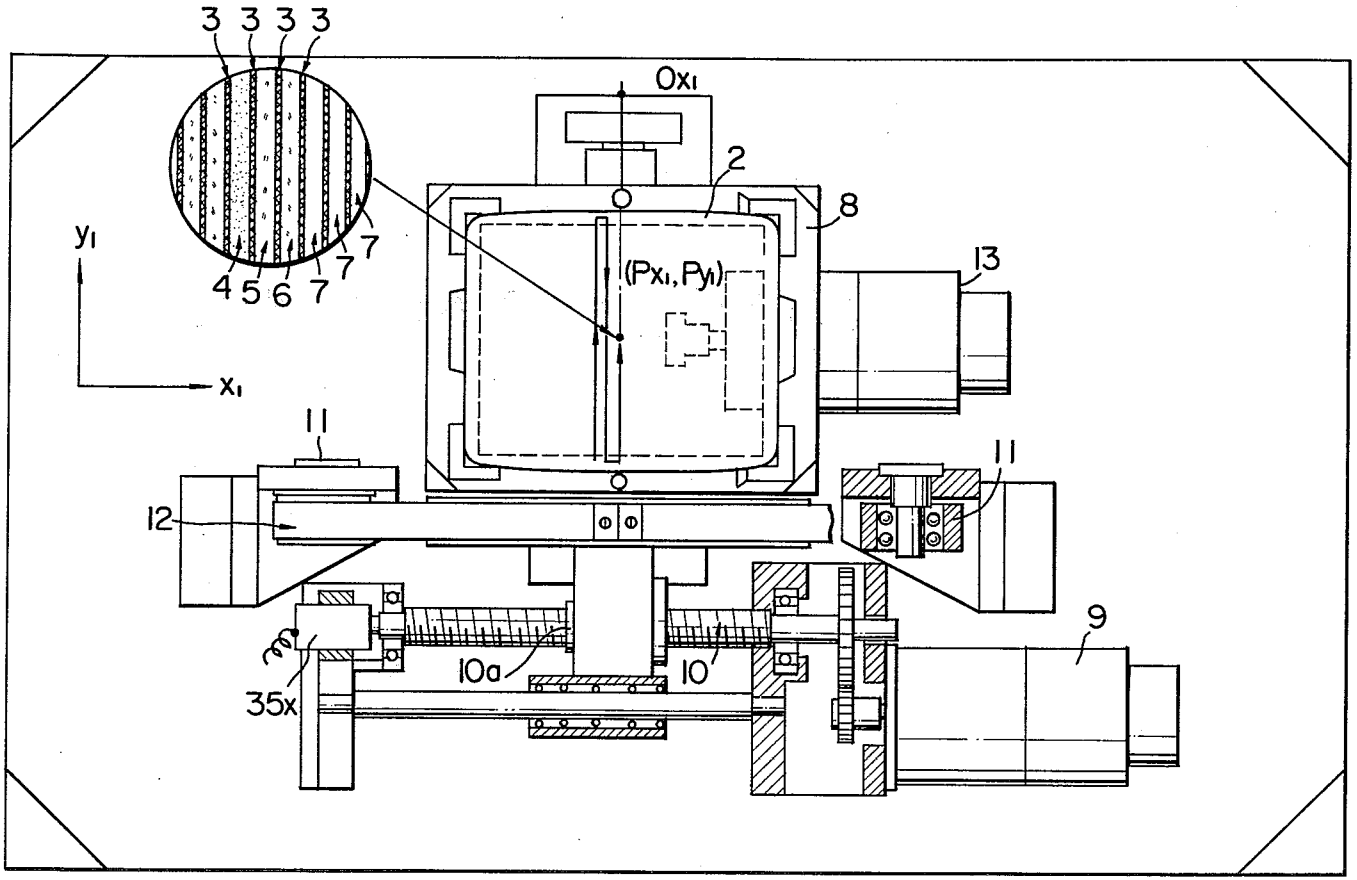
FIGS. 2A to 2F show a coating apparatus for a spherical faceplate in accordance with one embodiment of the present invention.
Figures 2B, 2E, 2F:
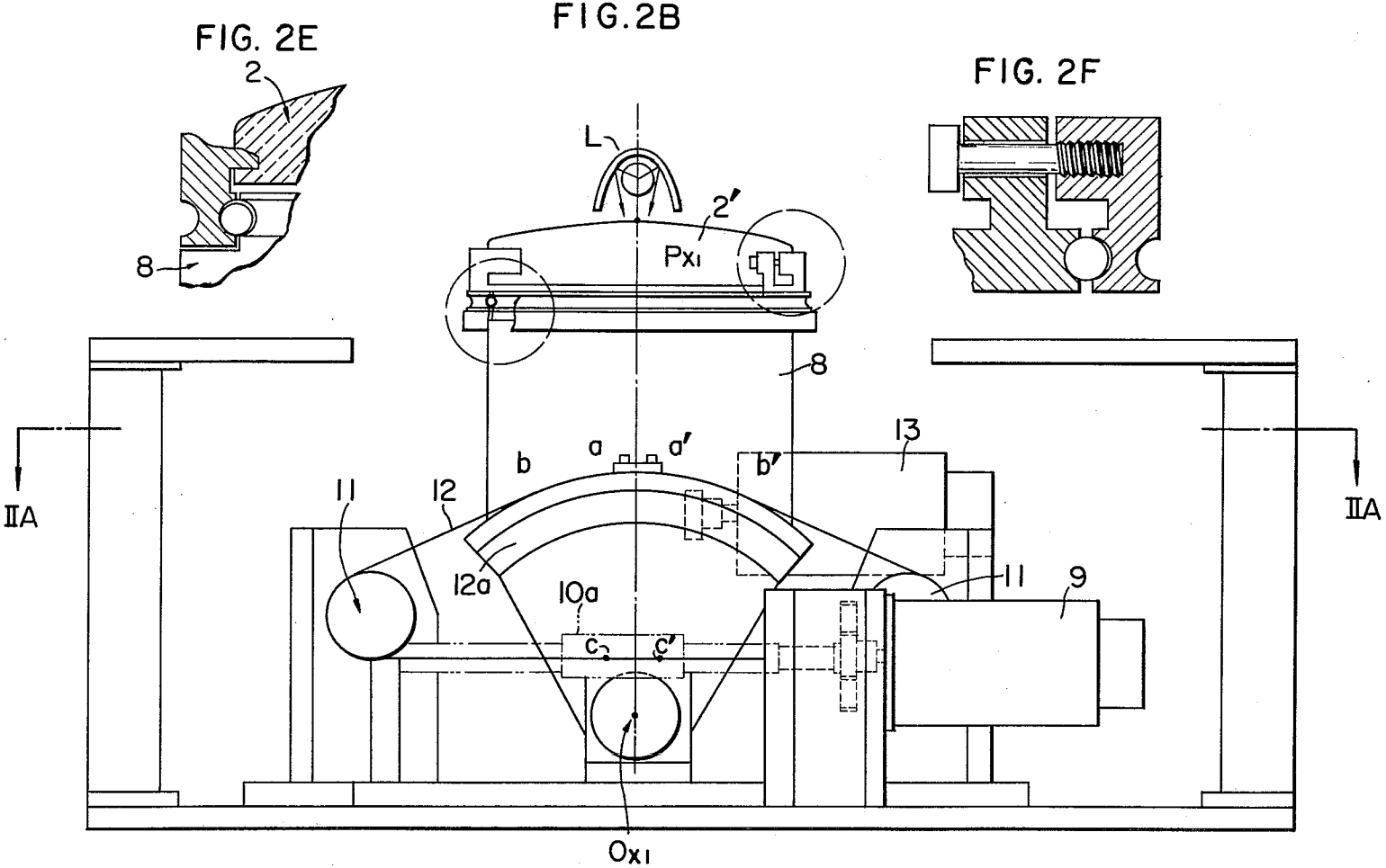
Figure 2D:
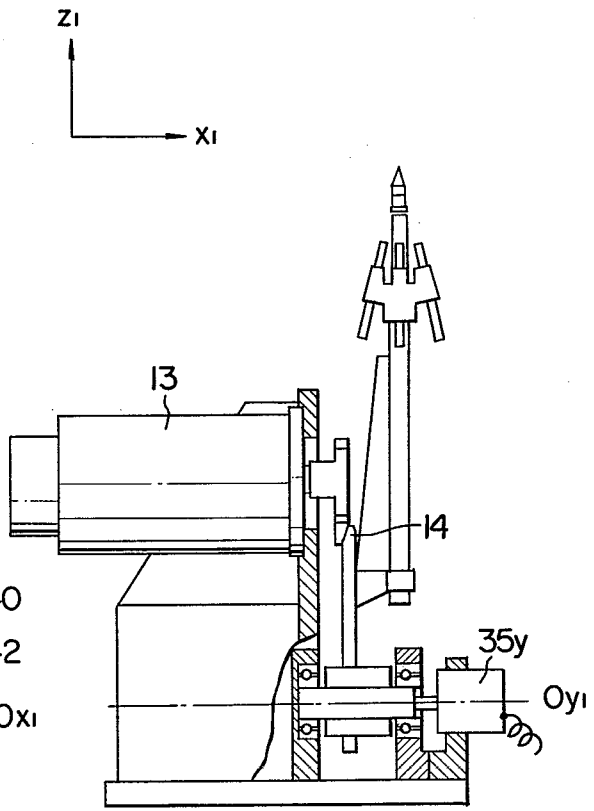
Figure 2C:
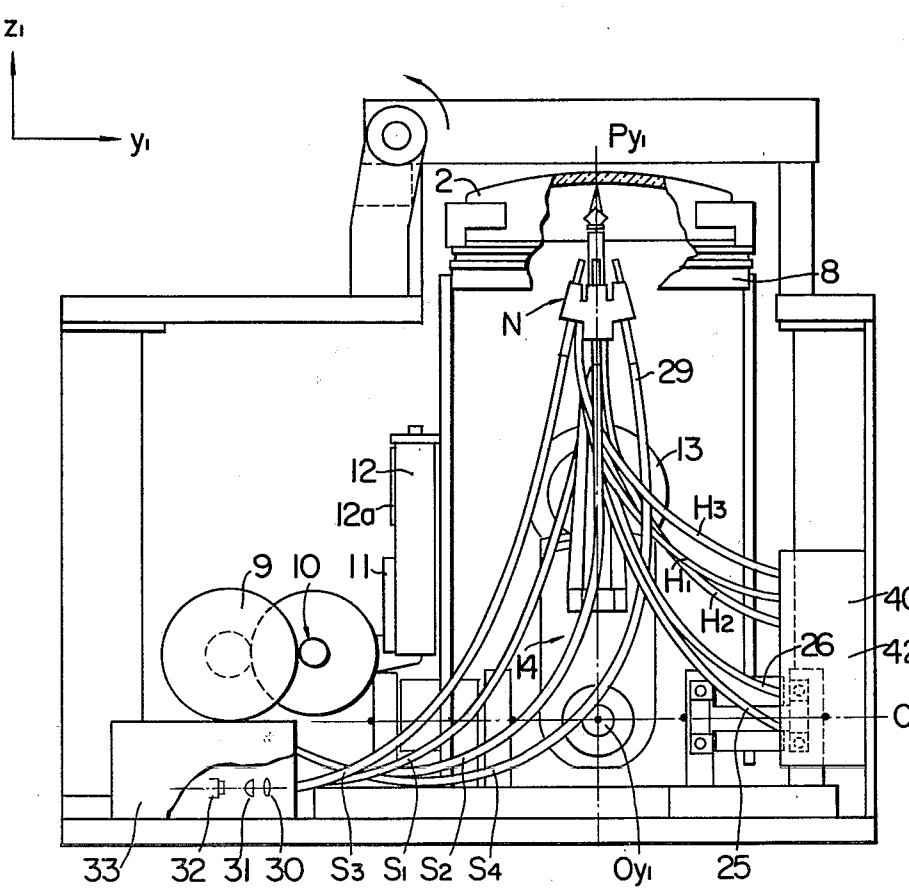

Reference is made to FIGS. 2A to 2D which show an apparatus for coating the phosphor material onto the inner surface of the panel having a spherical faceplate. FIG. 2A is a top view, taken along line IIA–IIA in FIG. 2B, of the phosphor material coating apparatus which holds a panel 2' at a predetermined position. It particularly shows an arrangement of the phosphor materials applied to the panel and a structure of a means or mechanism for moving a nozzle assembly, which is to be explained later, perpendicularly to the light absorbing material stripes 3 on the faceplate of the panel and in the plane of the faceplate (hereinafter referred to as an $x_1$-direction for simplicity sake). FIG. 2B is a front view of the coating apparatus shown in FIG. 2A and shows the $x_1$-direction moving mechanism and the panel in its hold position. FIGS. 2C and 2D are side elevational views of the entire and a portion of the coating apparatus shown in FIG. 2A, respectively, and they particularly show the nozzle assembly to be described later and a structure of a mechanism for moving the nozzle assembly in a direction perpendicular to the $x_1$-direction and in the plane of the faceplate (hereinafter referred to a $y_1$-direction for simplicity sake).

In FIG. 2A, each of the G, B and R phosphor materials 4, 5 and 6 is applied on substantially transparent striped windows 7, which are defined by the light absorbing material stripes 3 formed by the well known photolithographic process, for example. The striped windows 7 are arranged perpendicular to the longitudinal direction (i.e., perperpendicular to the $x_1$-direction) of the faceplate, (that is, in the $y_1$-direction), and the nozzle assembly is moved reciprocally in the $y_1$-direction while being guided by the striped windows 7 to form the striped phosphor screen, as will be described later. Let us assume that a nozzle of the nozzle assembly which is discharging a G phosphor material is at a point P on the inner surface of the faceplate 2. A positional coordinate ($P_{xl}$, $P_{yl}$) of the point P will be apparent from the operation of the $x_1$-direction and $y_1$-direction moving mechanisms shown in FIGS. 2B to 2F. FIGS. 2E and 2F are magnified illustrations of the circled portions on FIG. 2B. That is, as shown in FIGS. 2B, 2E and 2F, the panel 2' is fixed at a predetermined position by a panel support 8, which has clamps for chucking four corners of the panel 2' when bolts are screwed as shown in a partial enlarged view. In order to match the direction of the striped windows 7 at the center of the inner surface of the faceplate of the panel 2' with the direction of sweep of the $y_1$-direction moving mechanism, a stage for adjusting $x_1$-axis and $y_1$-axis angles of the panel may be formed between the panel 2' and the panel support 8' by a contact having a circular cross-section. In this manner, the panel is fixed at the predetermined position.

The $x_1$-direction moving mechanism imparts an arcuate motion in the $x_1$-direction of the faceplate 2 to the panel 2' around a center of curvature $O_{xl}$ of the faceplate in the $x_1$-direction. That is, as shown in FIGS. 2A and 2B, the rotational movement of an $x_1$-direction motor 9 is conveyed to a belting device through a feed gear including a first gear element attached at one end of the motor 9, an $x_1$-direction feed screw 10 and a second gear element attached at one end of the feed screw 10 to mesh with the first gear attached at the end of the motor 9 for conveying the rotational movement of the motor 9 to the $x_1$-direction feed screw 10. To this end, a nut 10*a* on the $x_1$-direction feed screw 10 has one side thereof linked to a linear ball bearing on a slide shaft and the other side thereof linked to a belt 12 of the belting device to be described later. Since the $x_1$-direction feed screw 10 is supported by the slide shaft, the rotational movement of the screw 10 is converted to a linear movement of the nut 10*a* on the screw 10. Thus, the linear movement of the nut 10*a* is now conveyed to the belt 12. The linear movement of the belt 12 is then conveyed to a wheel segment 12*a*, which has the center axis $O_{x1}$ integral with the panel support 8, through belt wheels 11 at the opposite ends in the $x_1$-direction of the $x_1$-direction moving mechanism. Thus, the belting device includes the belt 12 and the belt wheels 11. The belt 12 has its sides fixed at points c and c' on the nut 10*a* on the feed screw 10 and also coupled to points a and a' on the wheel segment 12*a* so that it is tangential at points b and b' on the wheel segment 12*a*. The $x_1$-direction moving mechanism can be applicable to a color picture tube having a spherical or cylindrical panel in which a faceplate is curved in the $x_1$-direction.

By properly selecting the radius of curvature $\overline{O_{x1}P_{x1}}$ of the faceplate and the radius of curvature $\overline{O_{x1}a(a')}$ of the wheel segment, it is possible to directly convert a rotational displacement of the $x_1$-direction motor 9 to a distance along the faceplate 2 with any selected conversion coefficient. In the preferred embodiment, where the minimum rotational displacement of the $x_1$-direction motor 9 is 1/2000, the speed reduction ratio is $\frac{1}{2}$, the lead (pitch) of the ball screw 10 is 5 mm and the ratio of $\overline{O_{x1}P_{x1}}$ to $\overline{O_{x1}a}$ is 2:1, then the linear displacement of the nut 10*a* on the ball screw or the feed screw 10 is 1.25 μm when the $x_1$-direction motor 9 rotates by 1/2000 revolution, and when the nut 10*a* is driven by 1.25 μm, the nozzle of the nozzle assembly will be relatively moved by 2.5 μm with respect to the faceplate. That is, the minimum drive unit of 2.5 μm for the nozzle on the faceplate is obtained only by the mechanical conversion. Furthermore, in this system, since the movement is transmitted by the feed screw 10 and the belt 12, the vibration is small and hence higher precision is attained.

FIGS. 2C and 2D show the $y_1$-direction moving mechanism which has a drive center axis or a stationary bearing at the center of the $y_1$-direction radius of curvature $\overline{O_{y1}P_{y1}}$ of the faceplate 2. The rotational movement of the $y_1$-direction motor 13 is converted to the $y_1$-direction reciprocal arcuate movement on the faceplate by such as arrangement that a gear attached at the end of the rotation axis of the $y_1$-direction motor 13 meshes with a gear segment device 14 fixed around the center axis $O_{y1}$. Therefore, the nozzle assembly N with a sensor and others attached thereto including an image guide 29 to be described later is moved in the $y_1$-direction.

Figure 3A:
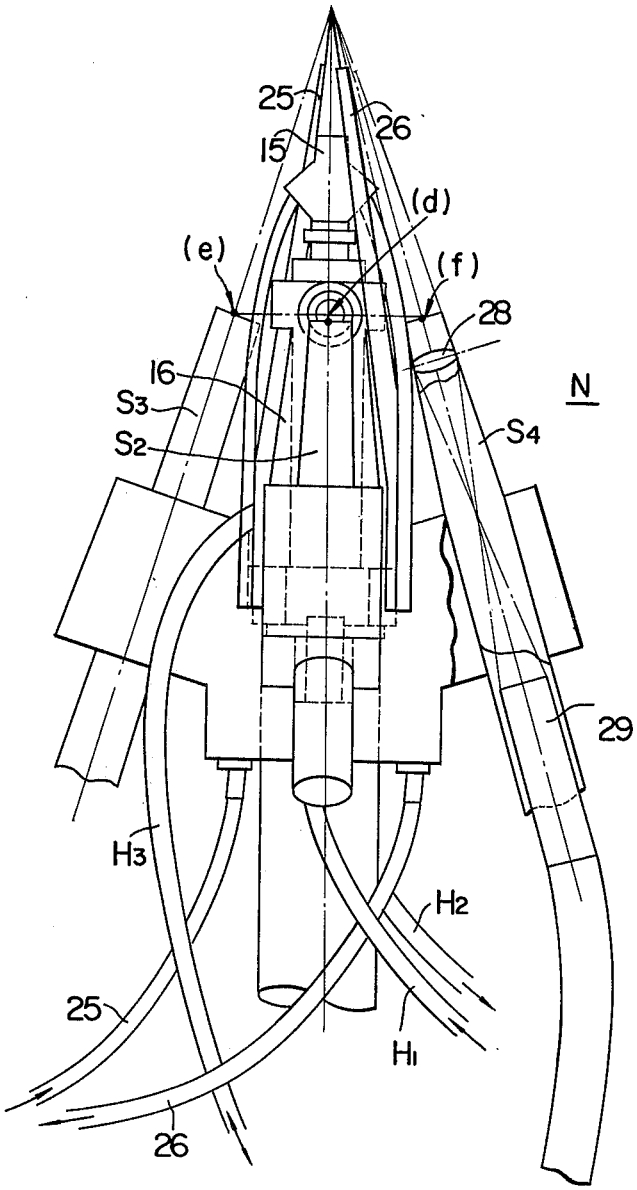
FIGS. 3A to 3E show a nozzle assembly and the operation thereof.

In FIGS. 2C and 3A, the nozzle assembly N having a nozzle 15 and a pair of effluence supply 1 collett hoses $H_1$ and $H_2$ is attached to the gear segment device 14 of the $y_1$-direction moving mechanism. Attached to the nozzle assembly N are means $S_1$-$S_4$ for detecting the position of the nozzle 15 relative to the faceplate 2, a rinsing pipe 25, a suction pipe 26 and an air suction/exhaust hose $H_3$ for turning on and off the nozzle 15. The hoses $H_1$-$H_3$ and the pipes 25 and 26 are coupled to a driver circuit 40 and a control signal generator 42 to be described later (See FIG. 7, 40*z*, 40*dx*, 42T, 42N). The nozzle position detecting means comprises DX control sensors $S_1$ and $S_2$ for detecting minute displacement of the nozzle in the $x_1$-direction and DZ control sensors $S_3$ and $S_4$ for detecting minute displacement of the nozzle in the direction perpendicular to the faceplate (hereinafter referred to as a $z_1$-direction for simplicity sake), the sensors $S_1$-$S_4$ operating optically. As shown in FIG. 2B, a light source L is arranged on one side of the panel which is opposite to the nozzle assembly N so that light is projected onto the faceplate 2. The light source L is elongated in the $y_1$-direction and it can be deflected through an angle of more than 90° around a rotation shaft in the direction of an arrow shown in FIG. 2C when the panel 2' is to be detached, and when the panel 2' is mounted as shown in FIG. 2, the light source L irradiates the faceplate at the predetermined position independently of the $x_1$-direction location of the faceplate. The light source L may comprise a high pressure mercury arc discharge lamp having an arc length of approximately 300 mm and a reflecting mirror having a parabolic surface for directing all the lights emitted from the arc discharge lamp to the faceplate. Through the radiation of light from the light source L, it is possible to detect the relative position of the nozzle 15 relative to the light absorbing material stripes 3 of the faceplate 2 and to the striped windows 7 using the sensors $S_1$-$S_4$. The operation of the sensors will be explained later. In the coating apparatus for the spherical faceplate shown in FIGS. 2A–2F, the panel 2' (faceplate 2) lies vertically upward of the nozzle assembly N (nozzle 15) so that the effluent is discharged from the nozzle 15 to the faceplate 2 in the direction against gravity. Consequently, the width of the effluent stripes is easy to control and the variation among the widths is reduced. Furthermore, foreign material is hard to be deposited on the effluent stripes.

Figure 3B:
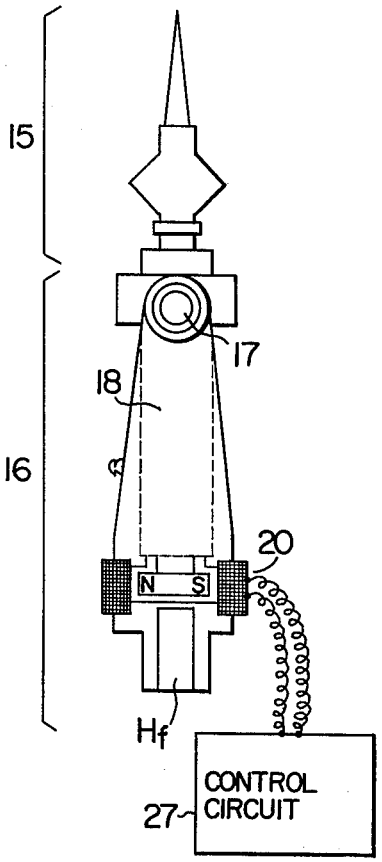
Figure 3C:
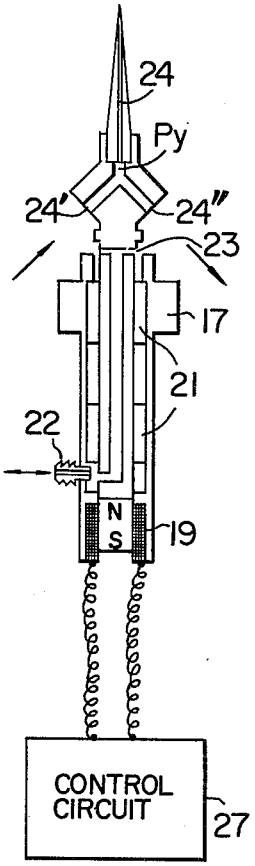

Referring to FIGS. 3B and 3C, the nozzle assembly N free from the nozzle position detecting means, the pipes and the hoses is shown to include the nozzle 15 and a nozzle body 16. The nozzle 15 and the nozzle body 16 are driven when a control circuit 27 receives a control signal relating to the drive of the $x_1$-direction moving mechanism and the $y_1$-direction moving mechanism. The nozzle body 16 has a tilting case 18, and the nozzle 15 and the nozzle body 16 are pivotably supported by a radial bearing 17 mounted at one end (upper end in FIG. 3B) of the tilting case 18. Mounted at the other end (lower end in FIG. 3B) of the tilting case 18 is means or device 20 for minutely moving the other end of the nozzle 15 in the $x_1$-direction (laterally in FIG. 3B), that is DX moving device or means, and a mounting hole $H_f$ for fixing a device necessary for coupling the $y_1$-direction motor 13 with the nozzle assembly is formed at the other end of the tilting case 18. The DX moving device 20 may comprise a permanent magnet and an interacting wound coil, as shown. More particularly, by using the radial bearing 17 mounted at the titling case 18 as a support point and establishing the distance between the upper limit of the stroke of the nozzle 15 and the radial bearing and the distance between the radial distance 17 and the DX moving device 20 to be equal, the movement of the magnet in the DX moving device 20 can be effective with the same amount of drive although the magnet is moved in opposite direction to the nozzle 15. The nozzle 15 has a Y-shaped passage Py for discharging a phosphor material or the like. Ports 24' and 24'' of the passage $P_y$ function to supply and collect the effluent and they are connected to the hoses $H_1$ and $H_2$, respectively. The other port functions as a discharge port and is connected to a nose portion of the nozzle 15. Small holes having diameter of approximately 200 μm are formed at the nose portion of the nozzle 15. The effluent is introduced into the nozzle from the supply port 24' under a compressed condition, and a predetermined portion of the supplied effluent (e.g. 1/100 by volume ratio) is discharged from the hole 24 at the end of the nozzle 15. The remaining effluent is passed to the collect port 24'' and recirculated. The compression supply of the effluent prevents the effluent from accumulating or clogging in the hoses $H_1$ and $H_2$, the passage $P_y$ in the nozzle or the small hole 24 because the effluent is fine power having grain size of 10 μm-20 μm and having relatively large specific gravity (approximately 4–7 gr/cm$^3$).

Figure 3D:
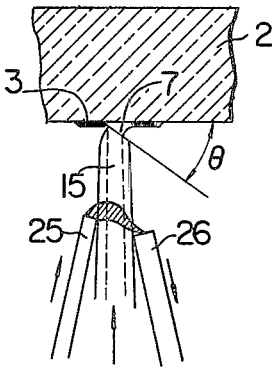

As described in conjunction with FIGS. 2A–2F, the coating apparatus runs through a cycle of $y_1(+)$-direction movement (sweep)→$x_1$-direction pitch feed→$y_1(-)$-direction movement (sweep)→$x_1$-direction pitch feed→$y_1(+)$-direction movement (sweep), and it performs a so-called cursive operation. However, if the effluent is continuously discharged during the repetitive operation, undesired lines will be drawn on the inner surface of the faceplate 2 during the $x_1$-direction pitch feed. In order to prevent the undesired lines from being drawn, during the $y_1$-direction sweep of the nozzle 15, the nozzle 15 is kept in "ON" condition in which it discharges the effluent on one striped window 7 with a predetermined gap held constant between the nozzle 15 and the faceplate 2, as shown in FIG. 3D, and during the periods other than the $y_1$-direction sweep periods of the nozzle 15, the nozzle 15 is kept in "OFF" condition in which the nozzle 15 is stroked to the lower limit to stop the discharge of the effluent. That is, during the periods other than the $y_1$-direction sweep periods, such as during the $x_1$-direction pitch feeding, the nozzle must be moved away from the faceplate 2 so that it does not collide with the light absorbing stripes 3. Although it is considered natural to stop the feed of the effluent to the compression supply port 24' of the nozzle 15 in order to prevent the undesired lines from being drawn, it takes approximately five seconds or more from the stop of compression feeding to the actual stop of discharge from the nose portion of the nozzle 15 because of the propagation delay of the effluent and it takes approximately 3 seconds or more from the start of the compression supply to the start of discharge. Furthermore, the width of the stripe is not stable for a certain period after the start of the sweep.

In the nozzle assembly N used in the present invention, the nozzle 15 is vertically movably supported by a pair of linear ball bearings 21 (e.g., NSK-No. LB4Y, manufactured by Nippon Seiko K. K., Tokyo, Japan) mounted in the nozzle body 16, at the axial precision of ±10 μm. Since the inner surface of the faceplate 2 of the panel has a roughness of approximately ±3 mm throughout the surface, hence it is very difficult to hold the nozzle 15 in non-contact manner (with a gap of approximately 10 μm) along the uneven inner surface of the faceplate 2. The illustrated nozzle assembly has a gap adjusting mechanism for that purpose. Compressed air under approximately 0.05 kg/cm$^2$ is injected from an air supply port 22 formed near the end of the nozzle body 16 to float the nozzle 15. The compressed air is ejected from an air port 23 formed at the lower end of the nozzle 15 and also ejected through the inside of the linear ball bearings 21.

In FIG. 3C, in order to carry out the ON/OFF operation of the nozzle 15 rapidly, it is necessary to increase the pressure of compression until a certain stroke during the $z_1$-direction stroke toward the faceplate 2 to increase the speed of air. However, if the pressure of compression is continuously increased, the nozzle 15 may overrun in the $z_1$-direction to collide with the faceplate, and in the worst case, it may damage the light absorbing material stripes 3 and the faceplate. In order to prevent the above event from occurring, an air purging port 23 is formed at the shaft of the nozzle 16. The air purging port 23 is located within a body casing 17 at the lower limit of the stroke. Under this condition, when the compressed air is supplied from the air supply port 22, the resulting compressive force is in the $z_1$-direction because the leakage of pressure is low. However, as the stroke reaches near the upper limit, the air purging port 23 is exposed through the nozzle body 16 and the $z_1$-direction compressive pressure instantly considerably decreases an it merely serves to slightly float the nozzle 15. From this time point, the tracking to the uneven surface of the faceplate 2 starts. That is, a $z_1$-direction position signal of the nozzle 15 relative to the faceplate 2 supplied from the sensor ($S_2$ or $S_4$ shown in FIG. 3A) is fed through the control circuit 27 to the DZ moving device 19, which may comprise a permanent magnet and an interacting wound coil, as shown. A gap between the faceplate 2 and the nozzle 15 is adjusted by the polarity and amplitude of a current supplied to the coil. Thus, it should be understood that the $z_1$-direction moving mechanism may include means for supplying compressed air to the nozzle body 16 through the air supply port 22.

Figure 3E:
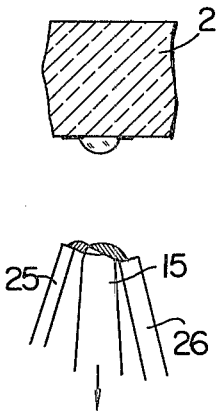

In FIG. 3D, the rinsing pipe 25 and the suction pipe 26 are attached near the nose portion of the nozzle 15 and aligned in the diametrical direction. Under the "ON" condition of the nozzle 15, the rinsing liquid discharged from the rinsing pipe 25 washes the end of the nozzle 15 and maintains the nozzle 15 at a predetermined temperature. $\theta$ denotes a nozzle discharge angle. In FIG. 3E, under the "OFF" condition of the nozzle, the nozzle 15 descends to the lower limit of the stroke so that the end thereof is located at the substantially same level as the end of the suction pipe 26. As a result, the effluent discharged from the end of the nozzle 15 is sucked along with the rinsing liquid. The rinsing liquid has a composition which readily dissolves the effluent and consists of 25% by weight of glycerine, 25% by weight of ethanol, 25% by weight of water and 25% by weight of 0.5% aqueous solution of polyethylene oxide.

Figure 4A:
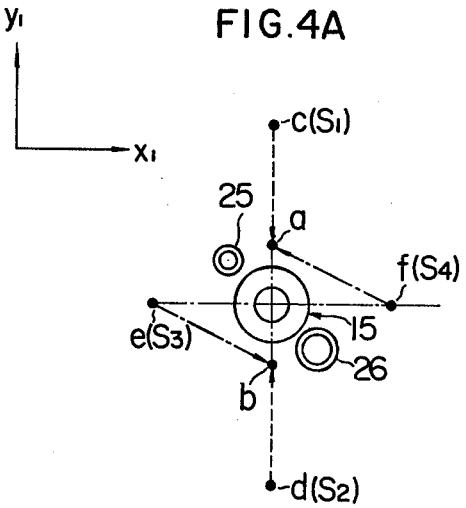
FIGS. 4A and 4B show an example of nozzle position detecting means for the nozzle assembly.
Figure 4B:
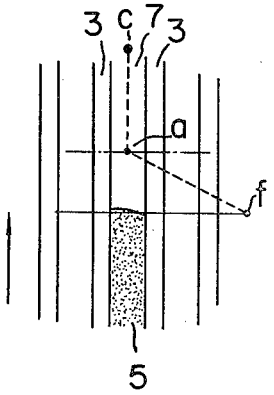

Referring to FIGS. 4A and 4B, an arrangement of the nozzle position detecting means is explained. As described above in conjunction with FIG. 3A, the nozzle position detecting means includes the DX control sensors $S_1$ and $S_2$ for detecting the minute displacement of the nozzle 15 in the $x_1$-direction and the DZ control sensors $S_3$ and $S_4$ for detecting the minute displacement of the nozzle 15 in the $z_1$-direction. Those sensors operate optically to detect a difference between transmission factors of the light absorbing material stripe 3 and the striped window 7 when the faceplate 2 is irradiated with light. They are mounted on the nozzle assembly N. Each of the DX control sensors $S_1$ and $S_2$ is located ahead of the nozzle in the direction of travel of the nozzle 15 to view a first forward area of the faceplate 2 when the nozzle assembly reciprocally sweeps in the $y_1$-direction. Accordingly, considering the nozzle 15 as an origin, the sensor $S_1$ or $S_2$ is located at a point c or d on the $y_1$-axis and views the first area containing the point a or b on the y-axis to provide a first component of information of the position of the nozzle 15 or $x_1$-direction position information. Each of the DZ control sensors $S_3$ and $S_4$ is located at an angle $\beta$ (FIG. 6B) with respect to a plane ($y_1$-$z_1$ plane) which is substantially perpendicular to the faceplate 2 and parallel to the $y_1$-direction to view a second forward area of the faceplate 2 ahead of the nozzle in the direction of the travel of the nozzle 15 when it reciprocally sweeps in the $y_1$-direction. Accordingly, considering the nozzle 15 as an origin, the sensor $S_3$ or $S_4$ is located at a point e or f on the $x_1$-axis and views the second area containing the point b or a on the y-axis to provide a second component of information of the position of the nozzle 15 or $z_1$-direction position information. The minute displacement of the nozzle 15 in the $x_1$-direction results from relative positional variation of the nozzle 15 with respect to the striped window 3. The minute displacement of the nozzle 15 in the $z_1$-direction results from the roughness of the inner surface of the faceplate 2.

As described above, the nozzle assembly N reciprocates on the inner surface of the faceplate 2 in the $y_1$-direction. As shown in FIG. 4B, when the nozzle assembly N sweeps the faceplates 2 in the $y_1$-direction shown by the arrow so that the nozzle 15 discharges the blue phosphor material 5 on the striped window 7 between the light absorbing material stripes 3, the point b is not measurable because the light to be used to measure the center position of the striped window 7 does not transmit through the faceplate 2 because of the phosphor material. Thus, when the nozzle assembly N sweeps the faceplate 2 in the $y_1$-direction (upward on the drawing) as shown in FIG. 4B, the point a is used as a measurement point, and when the nozzle assembly N sweeps the faceplate 2 in the $y_1$-direction opposite to the arrow (downward on the drawing), the point b is used as the measurement point. The points a and b are also located relative to the center of the nozzle 15 such that the positional control of the nozzle 15 is free from possible delay due to the response time of the means for minutely moving the nozzle in the $x_1$-direction and $z_1$-direction.

In FIGS. 3A and 4A, the DX control sensors $S_1$ and $S_2$ and the DZ control sensors $S_3$ and $S_4$ are provided at the points c, d, e and f, respectively, that is, two sensors are arranged in each of the $x_1$-direction and two in the $y_1$-direction symmetrically with respect to the center axis of the nozzle 15. However, when the sweep direction of the nozzle assembly N is reversed on the $y_1$-axis, the points c and f on the $x_1$-axis and $y_1$-axis, respectively, may be replaced by the points d and e, respectively, by rotating the center shaft of the nozzle 15 by 180° around the rotation axis so that the measurement point a or b can be automatically selected depending on the direction of the sweep of the nozzle 15 (upward or downward on the drawing), so that the measurement of the first and second forward areas is possible by one pair of sensors $S_1$ and $S_4$ or $S_2$ and $S_3$. Alternatively, the measurement points for the DX control sensors and the DZ control sensors may be displaced in the $x_1$-direction by the amount corresponding to one color pitch and the absolute position in the $x_1$-direction of the nozzle and the amount of displacement of the nozzle position from the center of the striped window are stored in a memory, so that when the sweep direction of the nozzle assembly N is next reversed, the positional control of the nozzle is based on the stored measurement. Furthermore, where the nozzle assembly returns to the start point for the following sweep in the $y_1$-direction after having completed the discharge of one or three kinds of phosphor materials on one or three striped windows and repeats the $y_1$-direction sweep along with the DX or DZ control, a similar measurement control can be carried out.

Figure 5A:
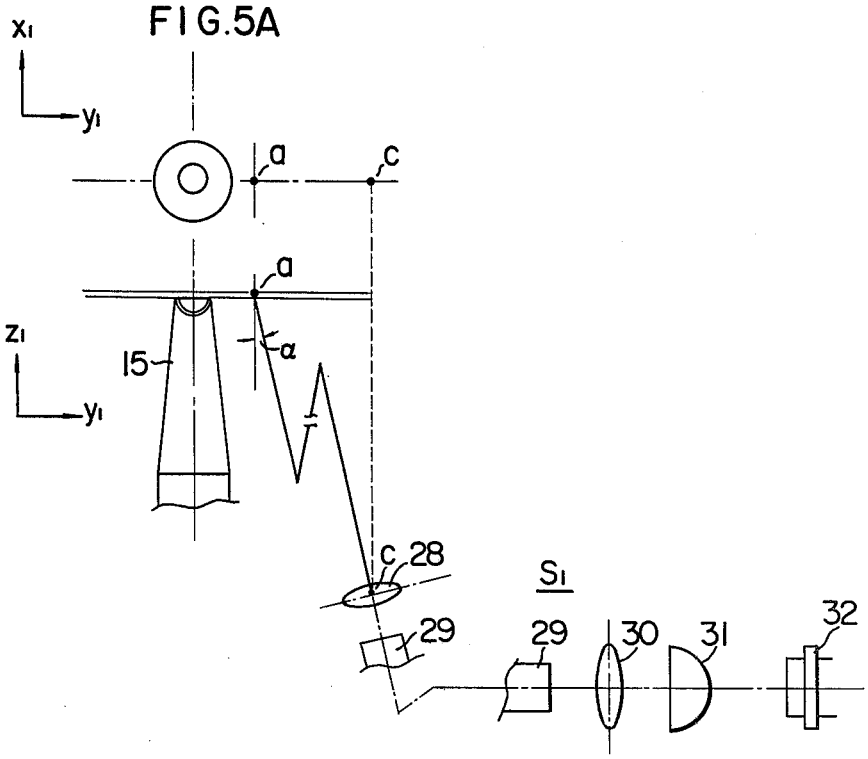
FIGS. 5A, 5B and 5C show a principle of operation and a construction of a sensor which is a part of the nozzle position detecting means and a block diagram of a positional error signal producing means which cooperates with the nozzle position detecting means.

The DX control sensors $S_1$ and $S_2$ and the DZ control sensors $S_3$ and $S_4$ may be of the same structure. FIG. 5A shows one of the sensors $S_1$–$S_4$ shown in FIGS. 4A and 4B, that is, the DX sensor $S_1$ arranged at the point c. The sensor $S_1$ includes an optical system for receiving light emitted from the light source and transmitted through the first forward area containing the point a of the faceplate 2, and a photoelectric transducer 32 coupled to the optical system. The transducer generates a first electrical signal representative of the forward area. In FIG. 5A, the optical system comprises a first objective lens 28 having an optical axis tilted by an angle $\alpha$ to a plane ($x_1$-$z_1$ plane) which is perpendicular to the faceplate 2 and to the striped window 7 and adapted to receive light emitted from the light source and transmitted through the faceplate 2, an optical fiber 29 for transmitting an image from the first objective lens 28, a second objective lens 30 for magnifying an image from the optical fiber 29, and a cylindrical lens 31 for focusing the image from the second objective lens 30 into an appropriate size of image. The photoelectric transducer includes charge-coupled device (CCD) 32. More particularly, the first objective lens 28 magnifies the image of the forward area containing the point a at the magnification factor of approximately 3 and projects the magnified image onto the surface of the light entrance of the optical fiber (an image fiberscope) 29. The image fiberscope 29 is mechanically flexible and integrated with the first objective lens 28, and it is fixed at a portion of the $y_1$-direction moving mechanism like the nozzle assembly N. The image focused at the light exit of the image fiberscope 29 is further magnified by the second objective lens 30 to project a real image on the CCD (CCD image sensor) 32 at a total magnification factor of 25. The cylindrical lens 31 is arranged between the second objective lens 30 and the CCD image sensor 32 so that the $x_1$-direction dimension and the $y_1$-direction dimension of the striped window 7 located between the light absorbing material stripes 3 shown in FIG. 4B are reduced by the factors of 1 and more than 1, respectively.

The CCD image sensor 32 may include 768 silicon photodiodes arranged at a pitch of 1 mil ($\div 25\ \mu m$). By projecting the optical image magnified at the magnification factor of approximately 25 to the CCD image sensor 32, a readout precision of 1 $\mu m$ per chip can be attained.

The CCD image sensor 32 performs a light accumulation operation. Input light accumulation at each of the chips produces a serial analog pulse output as shown in (g) in FIG. 5C. More particularly, by repeating charge and discharge of light input at an interval of 10 milliseconds, each chip of the CCD device is scanned at a speed of approximately $5\mu$ seconds per chip so that a deviation of the position of the nozzle 15 from the center position of the striped window 7 on the faceplate 2 is measured within approximately 3.84 milliseconds ($=768\times 5\mu$ seconds) to produce a positional error signal.

Figure 5C:
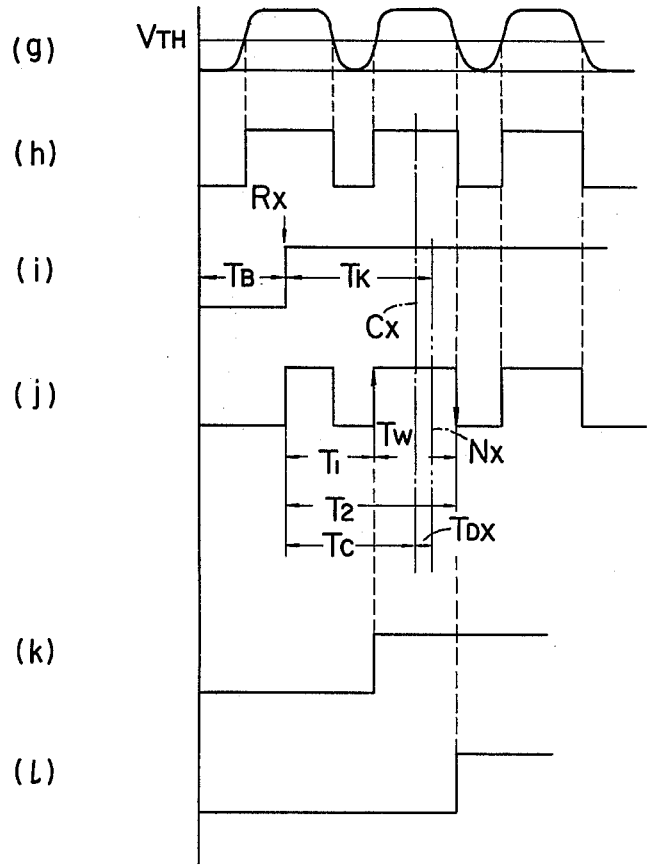
Figure 5B:
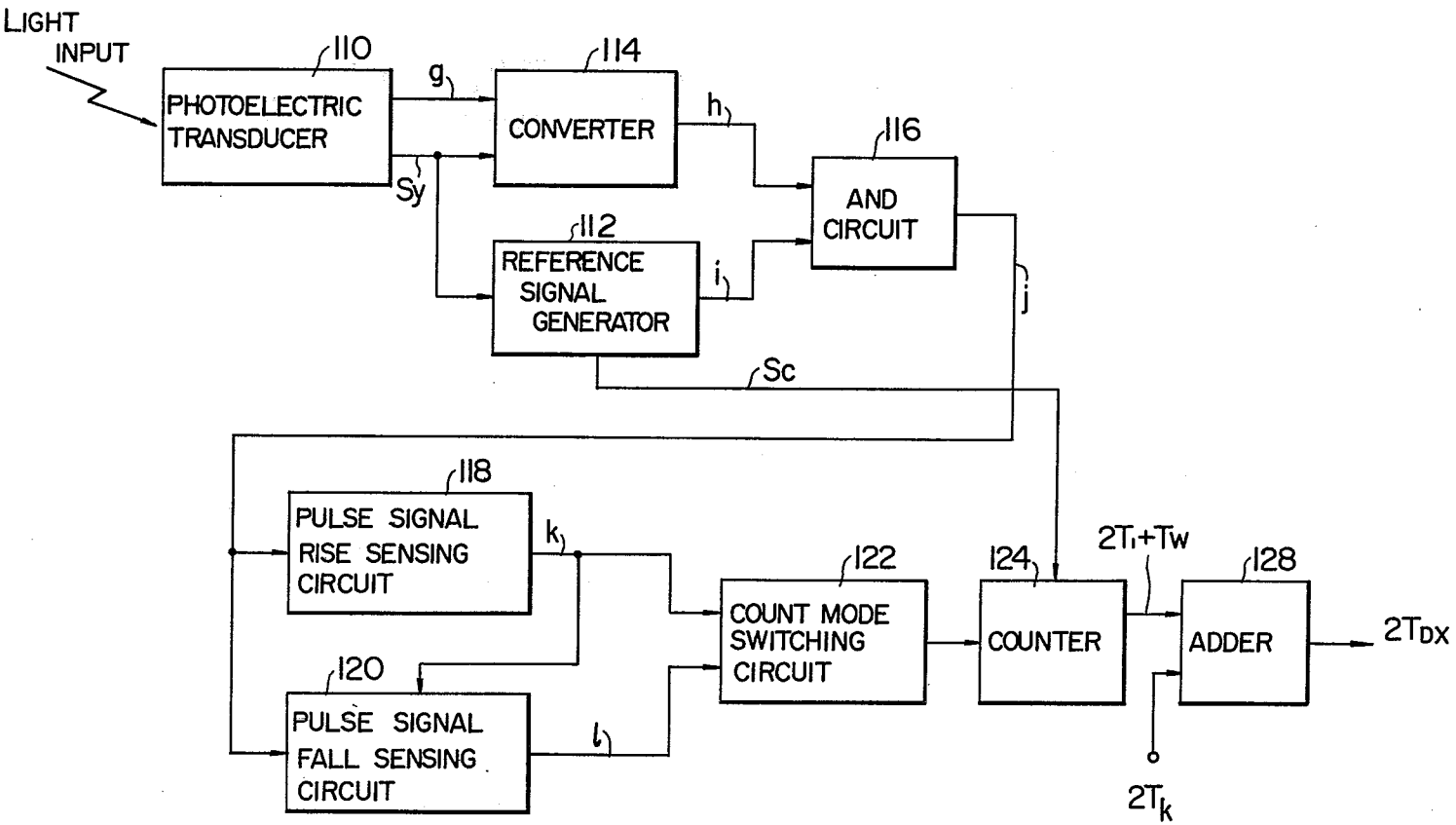

Referring to FIGS. 5B and 5C, the positional error signal producing means comprises a circuit 112 which receives an electrical signal g from a photoelectric transducer 110 including the CCD 32 to produce a reference signal i, a signal converter 114 responsive to the signal g to produce a pulse signal h which is used to find or recognize the center of a striped window, and a signal processing circuit including sections 116, 118, 120, 122, 124 and 128 for producing the positional error signal $T_{DX}$. The amplitude of the signal shown in (g) in FIG. 5C represents the transmission factor of the faceplate 2 of the panel. The signal g is compared with a predetermined level $V_{TH}$ in response to a synchronizing signal $S_y$ (not shown) supplied from the photoelectric transducer 110 to produce the pulse signal h having either "1" or "0" level, in order to discriminate the level of light strength intercepted by the light absorbing material stripes 3. In this manner, the center $C_x$ of the striped window to which the phosphor material is to be currently applied is recognized.

The signal i in FIG. 5C is the reference signal produced from the reference signal generator 112 in response to the synchronizing signal $S_y$ supplied from the photoelectric transducer 110 and it is produced to recognize the position of the nozzle 15 (more exactly, the discharging end of the nozzle 15) in the area of the faceplate 2 represented by the signal g or h. The reference signal i includes a portion $T_B$ for establishing a reference position $R_x$ with respect to the beginning of the signal g and a portion $T_K$ for the area from the reference position $R_x$ to a point $N_x$ a predetermined distance away from the reference position $R_x$. The signal portion $T_k$ defines the $X_1$-direction position of the nozzle 15, either directly or indirectly. The signal portion $T_B$ is at "0" level and its duration may be adjusted to correct and establish mechanical and optical reference positions of the nozzle 15 as well as those of the optical system including members 28–31 and the CCD device 32. It can be arbitrarily preset. The $R_x$ represents a reference point in the forward area which is viewed by the sensor $S_1$. The signal portion $T_k$ is at "1" level and a point $N_x$ at the rear end has a specific relation with the position of the nozzle 15.

The pulse signal h and the reference signal i are applied to the AND circuit 116, which produces an output as shown in (j) of FIG. 5B. In FIG. 5B, when the nozzle assembly N moves on the faceplate 2, the reference signal i does not change while the other signals g, h and j change with the movement of the nozzle assembly N. Based on the resulting signal j, the width of the striped window 7 is represented by a difference $T_W$ between $T_2$ and $T_1$, where $T_1$ represents the duration from the reference point $R_x$ to the first rise and $T_2$ represents the duration from the first rise to the fall immediately following the first rise. Duration $T_C$ from the reference position $R_x$ to the center $C_x$ of the striped window is given by $T_C=T_1+(T_2-T_1)/2=T_1+T_W/2$. The positional error signal $T_{DX}$ to be produced at this time is represented by a difference between the duration $T_C$ and the nozzle center position setting $T_K$, that is;

$$T_{DX}=T_K-T_C=T_K-(T_1+T_W/2)$$

The above signal processing is carried out by measuring the durations $T_K$, $T_1$ and $T_W$ using counters connected to a clock pulse source while serially counting the pulses corresponding to the duration $T_1$ by a factor of 2 and the pulses corresponding to the duration $T_W$ by a factor of 1. Since the above equation is written as $$2T_{DX}=2T_K-(2T_1+T_W)$$

when the pulses are counted for the duration of $T_2$ in (j) of FIG. 5C, the value $2T_{DX}$ which is double of the positional deviation of the nozzle assembly N is calculated on real time.

Referring back to FIG. 5B, a clock signal $S_c$ (not shown) is supplied to the counter 124 from the reference signal generator 112. A pulse signal rise sensing circuit 118 senses the first rise of the signal j to produce a signal k and a pulse signal fall sensing circuit 120 senses the fall immediately following to the first rise to produce a signal l. The signals k and l are applied to a count mode switching circuit 122, an output of which controls the count mode of the counter 124. Namely, during the duration $T_1$, the counter 124 counts the clock pulses $S_c$ at the double counting mode, and during the duration $T_W$ following $T_1$, it counts the clock pulses $S_c$ at the normal counting mode. The content of the counter is then applied to one input terminal of the adder 128 while a predetermined constant value $2T_K$ is applied to the other input terminal of the adder 128. Thus, the adder 128 produces the control value $2T_{DX}$. Since the pulses during the duration $T_W$ are counted after the elapse of the duration $T_2$, the width of the striped window can also be measured so that the amount of discharge of the phosphor material from the nozzle 15 can be controlled.

Figure 6A:
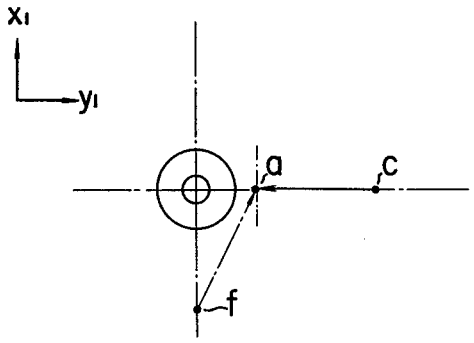
FIGS. 6A to 6C show a principle of operation of another sensor which is a part of the nozzle position detecting means.
Figure 6B:
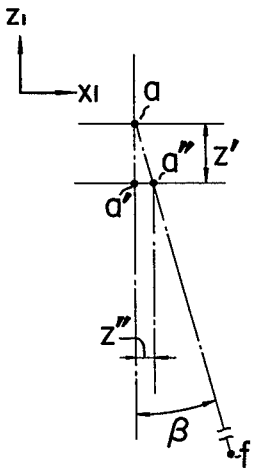
Figure 6C:
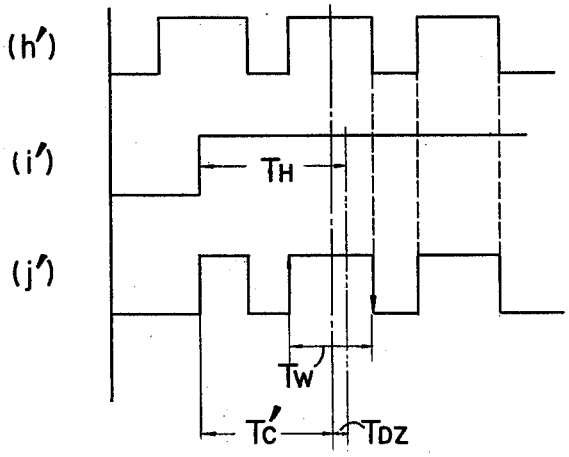

FIGS. 6A and 6B are similar to FIG. 5A, and FIG. 6C is similar to FIG. 5B. The DZ control sensor $S_4$ located at the point f is shown there by way of example. The DZ control sensor $S_4$ includes a similar optical system and photoelectric transducer to those of the DX control sensor $S_1$ shown in FIG. 5A, and it is arranged to view the second forward area containing the point a from the point f. The sensor $S_4$ receives the light transmitted through the second forward area to sense a gap between the nozzle 15 and the faceplate 2. It is apparent that this gap changes depending on the roughness of the inner surface of the faceplate 2. As discussed above, the sensor $S_4$ (more exactly, the optical axis of the optical system of the sensor $S_4$) makes an angle $\beta$ relative to the $y_1$-$z_1$ plane. Assuming that when the nozzle 15 has swept the faceplate 2 in the $x_1$-direction by a certain distance, a portion which is to be at the point a is at a point a' which is a distance z' away from the point a due to the roughness of the faceplate 2, the point a is observed as if it were located at a crosspoint a'' of a line segment $\overline{af}$ and a plane which contains the point a' and is parallel to the faceplate 2. At this time, $$\overline{a'a''} = z'' = z' \cdot \tan \beta$$

Thus, by measuring $z''/\tan \beta$, the resulting minute displacement z' in the $z_1$-direction can be determined.

The signal h' is a pulse signal which has been derived from a signal (not shown) similar to the signal g in FIG. 5B. The signals h' and g' change as the gap between the nozzle 15 and the faceplate 2 changes by the amount z'. (Signal g' is omitted.) Like in the case of FIG. 5C, the center position of the striped window can be represented by the duration $T_c'$ of the signal h', and a difference signal $T_{DZ}$ between $T_c'$ and a nozzle position representing portion $T_h$ of the signal j' derived by viewing the point a from the point f has a value correlated to $z''/\tan \beta$ or z'. $T_H$ defines the $z_1$-direction position of the nozzle 15 either directly or indirectly, and $\beta$ is physically constant. Thus, $\tan \beta$ can be regarded as a coefficient in the control system, and it is processed when the digital quantity $T_{DZ}$ is converted to an analog quantity to drive the $z_1$-direction moving mechanism 19. The means coupled to the nozzle position detecting means for producing the positional error signal $T_{DZ}$, shown in FIGS. 6A–6C may be similar to that shown in FIG. 5B.

Figure 7:
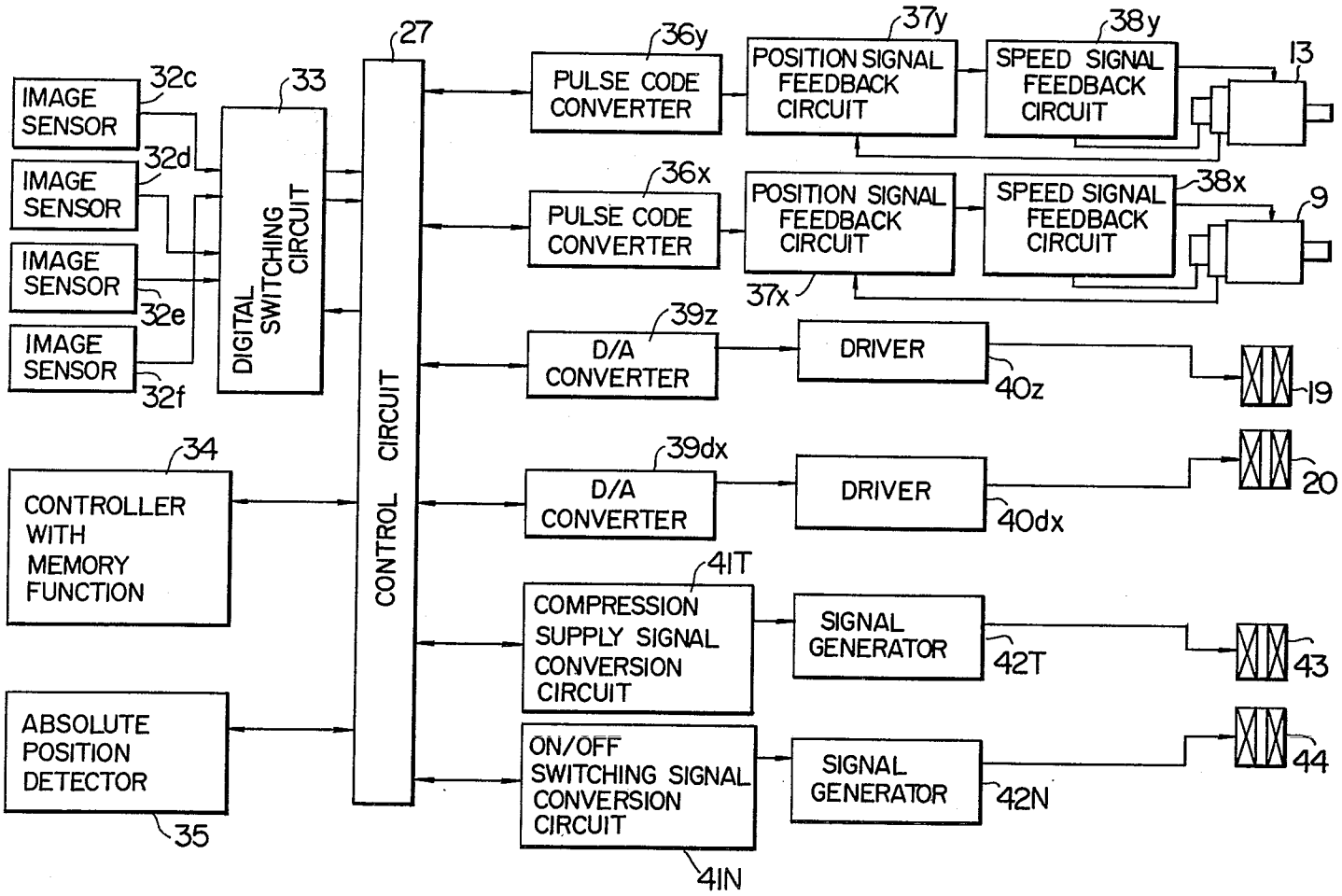
FIG. 7 is a block diagram of a control system for controlling the driving of the nozzle assembly and controlling the discharge from the nozzle assembly in accordance with one embodiment of the present invention.

FIG. 7 shows a block diagram of a control system for controlling the mechanisms for moving the nozzle assembly N in the $x_1$-direction, $y_1$-direction and $z_1$-direction and controlling the discharging operation of the nozzle assembly N. The system makes use of control signals from the image sensors described in conjunction with FIGS. 5A–5C and 6A–6C, information data from a controller 34 with memory function capable of storing and calculating control amounts such as a $y_1$-direction moving distance and $x_1$-direction moving distance of the nozzle, information data concerning the absolute position of the nozzle delivered from an absolute position detector 35, and reference signals generated from the control circuit itself in order to control the $x_1$-direction motor 9 of the $x_1$-direction moving mechanism, the $y_1$-direction motor 13 of the $y_1$-direction moving mechanism, the $z_1$-direction moving mechanism 19, the DX moving device 20, a compressed feeding control valve 43 for the effluent such as a phosphor material, and a positive/negative pressure switching control valve 44 for turning ON and OFF the nozzle 15.

The control circuit 27 exchanges information data with the controller 34 with function of storing and calculating control amounts such as $y_1$-direction movement distance and $x_1$-direction pitch feeding distance whereby discharges of the stripe forming material such as G, B and R phosphor materials on the faceplate 2 of the panel can be performed. As described above in conjunction with FIGS. 2A–2F, the striped windows 7 are arranged perpendicular to the longer side of the faceplate 2, that is, in the $y_1$-direction, but since the movement of the nozzle assembly N by the actuation of the $y_1$-direction moving mechanism including the $y_1$-direction motor 13 and of the $x_1$-direction moving mechanism including the $x_1$-direction motor 9 traces a divisional plane which passes through the center of curvature of the faceplate 2, the striped windows 7 are viewed on the plane of the faceplate of the panel as if they were not aligned exactly in the direction perpendicular to the longer side of the faceplate and as if they had a curvature on the divisional plane. The controller 34 with memory function also has a function to maintain the nozzle assembly within the distance of $\pm 50$ $\mu$m from the center of the striped window in the $x_1$-direction. This is carried out by previously calculating the curve of the striped window formed on the faceplate 2 and the tracking curve of the nozzle assembly which traces the faceplate 2. More particularly, the $y_1$-direction drive position and the $x_1$-direction drive position shown as ($P_{x1}$, $P_{y1}$) in FIGS. 2A–2C, 2E–2F or angles $O_{x1}$ and $O_{y1}$ between the center axes $O_{x1}$ and $O_{y1}$ of the $x_1$-direction and $y_1$-direction moving mechanisms, respectively, and the center axis of the nozzle assembly, are measured by the absolute position detector 35 including angular position sensors such as absolute shaft encoders **35*x* and 35*y*, which are mounted on the center axis $O_{x1}$ and $O_{y1}$ of the $x_1$-direction and $y_1$-direction moving mechanisms (FIGS. 2A and 2D). The information of the absolute position of the nozzle in the $x_1$-direction and $y_1$-direction is put into a previously stored paraboloidal locus to determine a distance $\Delta x_1$ to be driven by the $x_1$-direction motor when the $y_1$-direction motor 13 has driven a distance $\Delta y_1$. The above operation is serially repeated under the command of the control circuit 27. The result of the arithmetic operation is transferred from the control circuit 27 to the $x_1$-direction motor 9 to continue the $x_1$-direction drive of the faceplate 2 of the panel. The $x_1$-direction minute drive amount or DX value for the striped window on the faceplate 2, which is serially driven to a point within $\pm 50$ $\mu$m from the striped window center, is sensed at a readout precision of $\pm 1$ $\mu$m by the CCD image sensors 32*c* and 32*d* corresponding to the DX control sensors mounted at the points c and d in FIG. 4A to measure the forward areas of the nozzle in the $y_1$-direction. Furthermore, in combination with the CCD image sensors 32*e* and 32*f* corresponding to the DZ control sensors mounted at the points e and f, the DX correction amount and the DZ correction amount are transferred to the control circuit 27 through a data switching circuit 33** as the $y_1$-direction sweep proceeds.

All of the detected values, the stored values and the calculated values are collected at the control circuit 27, which provides drive timings and drive amount to the mechanisms to be controlled. Numerals **36*x* and 36*y* denote pulse code converters for transferring the drive amount to the $x_1$-direction motor 9 and the $y_1$-direction motor 13, respectively, numerals 37*x* and 37*h* denote position signal feedback circuits for detecting angular position of the motors, and numerals 38*x* and 38*y* denote speed signal feedback circuits for maintaining constant the rotation speed of the motors. Numerals 39*z* and 39*dx* denote D/A converters for analog-converting the pulse coded information, and numerals 40*z* and 40*dx* driver circuits for driving the $z_1$-direction moving mechanism 19 and the DX moving device 20 by the amount corresponding to the analog quantity. Numeral 41T denotes a compression supply control signal conversion circuit which receives a $y_1$-direction speed signal and a striped window width signal (both in digital form) from the control circuit 27 to produce analog signals corresponding thereto and also controls the operation of the compression supply control valve 43 which contributes to adjust the pressure in a tank which contains the material to be discharged, depending on whether the nozzle is discharging the material or not. Numeral 41N denotes an ON/OFF switching signal conversion circuit which receives information relating to whether the nozzle 15 is discharging the material or not and whether the $x_1$-direction pitch feed is being carried out or not, from the control circuit 27 to control the switch valve 44 which turns ON and OFF the nozzle 15. Circuits 42T and 42N receive the outputs from the circuits 41T and 41N to produce signals to control the valves 43 and 44**, respectively.

Each of the circuits described above automatically carries out its function under the control of the control circuit 27. The faceplate 2 is displaced on the faceplate support 8 and a start switch in the control circuit 27 is depressed so that each of the circuits operates in the following sequence.

(1) By depressing the start switch, each of the $x_1$-direction motor 9 and the $y_1$-direction motor 13 operates in accordance with the output from the absolute position detector 35 which detects the absolute angular position of the $x_1$-direction and $y_1$-direction motors 9 and 13 and then restores to the central point (original point) of the faceplate 2.

(2) Only the $y_1$-direction motor 13 is driven to measure a tilt between the center axis of the panel and the center axis of the panel support by the sensor $S_1$ (32*c*) or $S_2$ (32*d*).

(3) When the measurement has been completed, the nozzle assembly restores to the original point and the circuits 41T and 42T operate by the commands from the control circuit 27 to open the compression supply control valve 43 for making preparation for the compression supply of the phosphor material, and at the same time only the $x_1$-direction motor 9 is driven to a predetermined $x_1$-direction absolute position with the current $x_1$-direction position of the nozzle being compared with the output of the absolute position detector 35, so that the drive is stopped at the predetermined $x_1$-direction position.

(4) The $x_1$-direction motor 9 is further driven to another $x_1$-direction position at which the striped window 7 no longer exists while using the output signals from the CCD device 32*c* or 32*d* corresponding to the sensor $S_1$ or $S_2$. When the signal indicative of the absence of the striped window is produced, the $y_1$-direction motor 13 and the $x_1$-direction motor 9 are driven synchronously until a signal indicative of the absence of the striped window in the $y_1$-direction is produced.

(5) When the operation (4) above is completed, the nozzle assembly has reached the corner of the faceplate 2.

(6) The circuits 41N and 42N are then operated by the command from the control circuit 27 to turn ON the nozzle 15 and start the DX control and the DZ control. From the $x_1$-direction and $y_1$-direction absolute position signals from the absolute position detector 35, a minute drive amount $\Delta x_1$ in the $x_1$-direction when a $y_1$-direction drive has proceeded by the $y_1$-direction minute amount $\Delta y$ is calculated on the basis of the gradient of the curved stripes. The arithmetic operation is serially carried out until the predetermined $y_1$-direction distance is reached while drawing an optimum tracking locus for the striped window 7.

(7) At the completion of the drive for a predetermined $y_1$-direction distance, the circuits 41N and 42N are operated by the command from the control circuit 27 so that the nozzle 15 is turned OFF and the nozzle assembly is moved to the next striped window by the $x_1$-direction moving mechanism including the $x_1$-direction motor 9.

(8) The operations (6) and (7) are sequentially repeated by the number of times corresponding to the number of the striped windows.

Figure 8A:
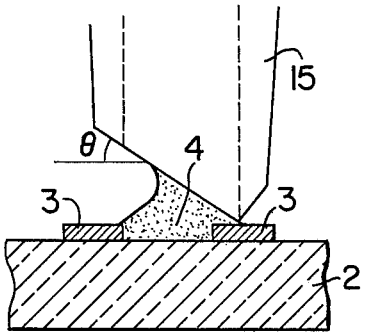
FIGS. 8A to 8C are sectional views of striped phosphor screens manufactured in accordance with the present invention.

The striped phosphor screen formed by the coating apparatus of the present invention is now explained. The material to be discharged (effluent) consists of 65 parts of green phosphor material, 10 parts of 10% aqueous solution of PVA as a compound agent, 10 parts of glycerine for preventing sedimentation of the phosphor material and enhancing the fluidity of the effluent, 3 parts of 0.5% aqueous solution of polyethylene oxide, 4 parts of 5% aqueous solution of sodium polyoxyethylene alkylphenol ether sulfate, 2 parts of ammonium bichromate and 6 parts of alcohol. As shown in FIG. 8A, the effluent was discharged from the end or the nose portion of the nozzle having an inner diameter of approximately 200 $\mu$m and an ejection angle $\theta$ of approximately 30°, at a flow rate of approximately 1.6 liters per minute. The discharge rate could be changed substantially linearly by changing the compression pressure, as described above, and the width of the strips of the phosphor material was 200 $\mu$m when the compression pressure was 1 kg/cm$^2$, 140 $\mu$m when 0.5 kg/cm$^2$ and 260 $\mu$m when 2 kg/cm$^2$.

For a 20-inch color picture tube, the width of the striped window was 175 $\mu$m with a growth of the light absorbing stripe of 90 $\mu$m, and the phosphor stripe material was formed to have a width of 200 $\mu$m. When the nozzle assembly is moved in the $y_1$-direction at a sweep rate of 40 cm/sec, the green phosphor material stripe of approximately 4 mg/cm$^2$ is formed in about five minutes. Thereafter, the blue and red stripes are similarly formed.

Figure 8B:
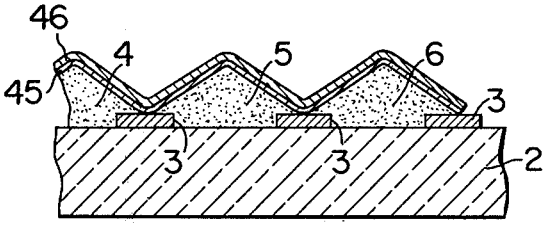

FIG. 8B shows a sectional view of the G, B and R phoshor stripes 4, 5 and 6 formed in accordance with the present invention. By cutting the end of the nozzle at the angle of approximately 30° so that the effluent receives tensions both by the end of the nozzle and the walls of the faceplate, the film of substantially triangular cross-section, that is, the film having a center thickness of 35 $\mu$m and an edge thickness of 10 $\mu$m is formed. In FIG. 8B, numerals 4, 5 and 6 denote G, B and R phosphor material stripes having curved cross-section formed between the light absorbing material stripes 3, numeral 45 denotes a filming layer of acryl emulsion or the like, and numeral 46 denotes an aluminum metal back layer. In FIG. 8B, the surface area of the aluminum metal back layer 46, as viewed from the faceplate 2, is 2.12 cm$^2$ per unit length of the stripe as compared with 2 cm$^2$ for the structure having planar stripes rather than convex stripes. Therefore, higher reflection effect is attained.

When three holes are formed in the direction of the arrangement of the stripes in the nozzle 15 mounted on the nozzle assembly, the phosphor material stripes for the three colors can be formed simultaneously. Furthermore, when the end of the nozzle 15 is shaped into paraboloid, the metal back 46 can be shaped into substantially a parabolic form.

Figure 8C:
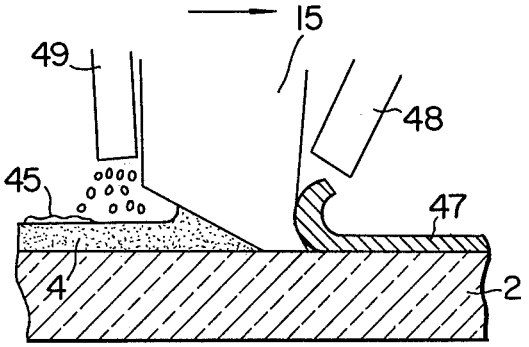

By providing another nozzle 49 which follows the nozzle for discharging the phosphor material as shown in FIG. 8C and applying filming liquid 45 such as acryl emulsion on the phosphor material stripes from the nozzle 49, the covering of the filming material is separated in a stripe pattern so that good aluminum coated metal back film which does not exhibit swelling phenomenon is formed, which in turn contributes to the enhancement of brightness of the resulting phosphor screen. Furthermore, by programming the sequential drive locus by the $x_1$-direction and $y_1$-direction moving mechanisms in accordance with the associated shadow masks, it is possible to scribe the light absorbing material 47 coated on the entire surface of the faceplate. Further, by mounting a vacuum hose 48 ahead of the nozzle 15 as viewed in the direction of travel as shown by the arrow, like the nozzle assembly shown in FIG. 3D, it is possible to automatically suck scribing refuse. Accordingly, it is possible to manufacture a phosphor screen of the black matrix type color picture tube by one run of drive operation.

Figure 9B:
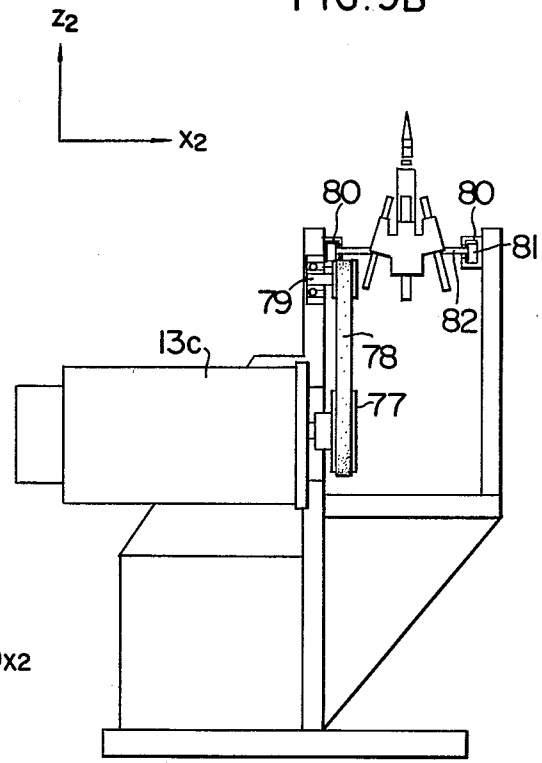
FIGS. 9A and 9B are perspective views of a coating apparatus for a cylindrical faceplate in accordance with one embodiment of the present invention.
Figure 9A:
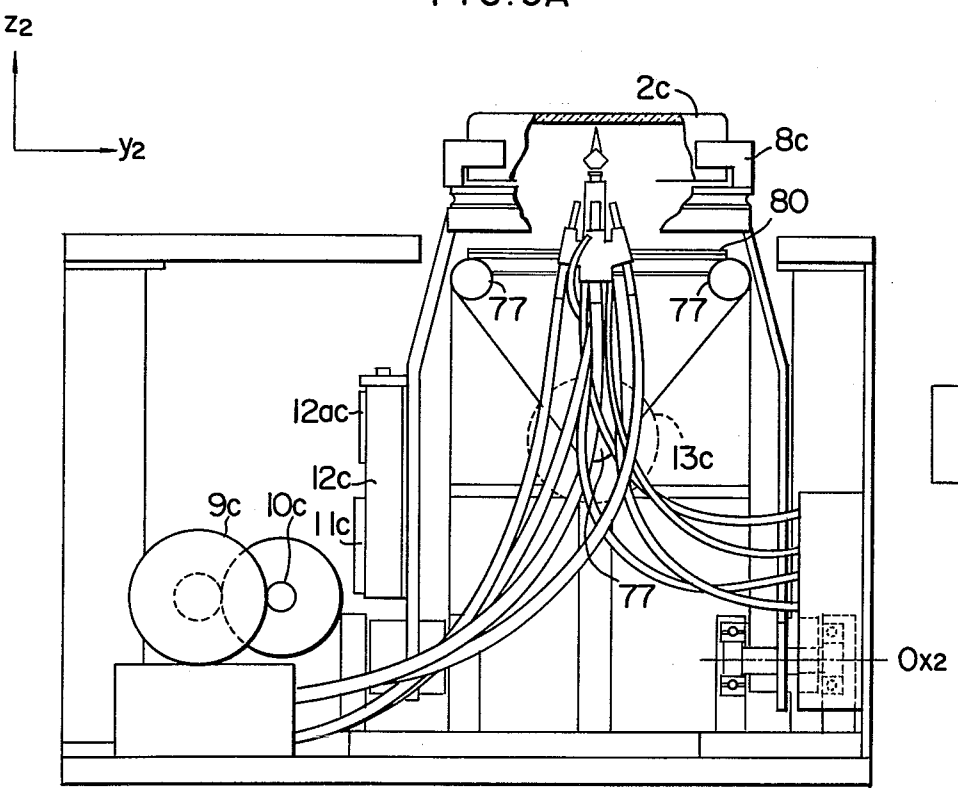

FIGS. 9A and 9B show an apparatus for coating phosphor materials on the inner surface of a panel having a cylindrical faceplate, and they are similar to FIGS. 2C and 2D. Like in the case of FIGS. 2A–2D, the direction perpendicular to the light absorbing material stripes in the plane of the faceplate 2*c*, that is, the longitudinal direction of the faceplate 2*c* is referred to as $x_2$-direction, the longitudinal direction of the light absorbing material stripes, that is, lateral direction of the faceplate 2*c* is referred to as $y_2$-direction, and the direction perpendicular to the faceplate 2*c* is referred to as $z_2$-direction. The faceplate 2*c* is fixed at a predetermined position by a panel support 8*c*. An $x_2$-direction moving mechanism comprises an $x_2$-direction motor 9*c*, a feed gear including a feed screw 10*c* for converting the rotational movement of the motor 9*c* to linear motion, a belting device including a belt wheel 11*c* and a belt 12*c*, and a wheel segment 12*ac* coupled to the belting device and the panel support 8*c*. The $x_2$-direction moving mechanism has a similar construction to that of the $x_1$-direction moving mechanism of the coating apparatus for a spherical faceplate shown in FIGS. 2A–2F. A nozzle assembly and a nozzle position detecting means (including light source) may be of the same constructions as those shown in FIGS. 2A, 3A–3D, 4A, 4B and 5A. In the present embodiment, since the faceplate 2*c* is not curved in the longitudinal direction of the stripes ($y_2$-direction), the $y_2$-direction moving mechanism is different from that shown in FIGS. 2C and 2D.

In the $y_2$-direction moving mechanism shown in FIGS. 9A and 9B, the rotational movement of the $y_2$-direction motor 13*c* is transmitted to a flat belt 78 by a belt pulley 77 mounted at the end of the motor shaft. A rotating drum 79 adjusts the amount of movement of the flat belt 78. The belting device including the belt pulley 77 and the belt 78 further includes a pair of guideways 80 extending parallely to each other in the $y_2$-direction to enable the sweep of the nozzle assembly in parallel to the $y_2$-direction sectional plane of the cylindrical faceplate 2*c*. The guideways 80 guide a bearing 81 and are directly coupled to a bearing shaft 82. A portion of the bearing shaft 82 is fixed to the flat belt 78 so that the nozzle is linearly driven on the inner surface of the cylindrical faceplate in synchronism with the movement of the flat belt 78 along the guideways 80.

In the embodiment shown in FIGS. 9A and 9B, like in the embodiment described previously, since the effluent is discharged to the faceplate from the nozzle of the nozzle assembly against the gravity, the width of the effluent material stripe can be readily controlled and the variation of the line width among stripes is reduced. Furthermore, foreign material is hard to deposit on the stripes.

Figure 10:
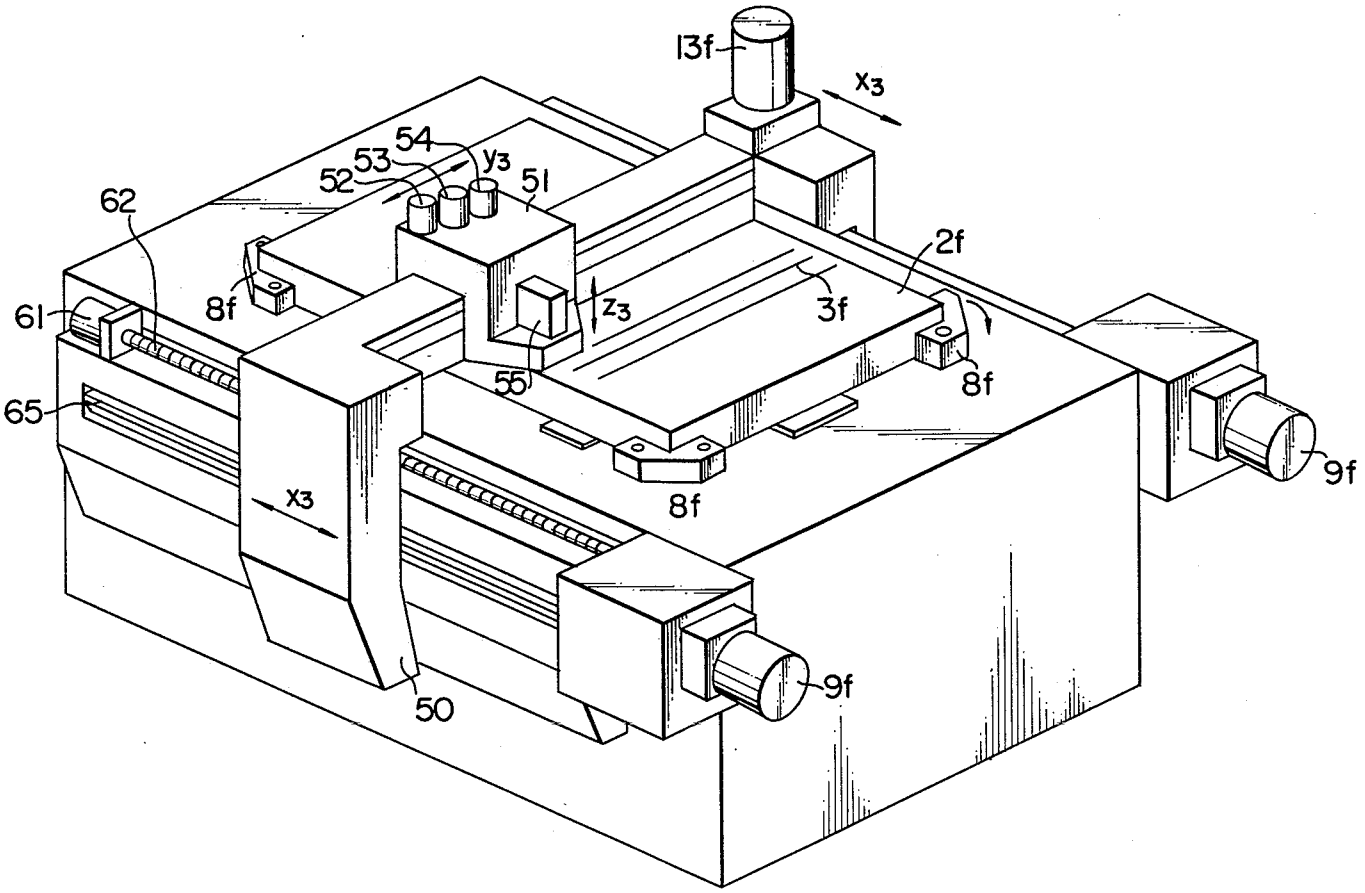
FIG. 10 shows a coating apparatus for a planar faceplate in accordance with one embodiment of the present invention.

FIG. 10 shows an apparatus for coating a phosphor material to the inner surface of a panel having a flat plate. Two of the four corners of a faceplate 2*f* are fixed in position and the other two corners are secured by a faceplate support 8*f*. A pair of guide rails 65 and a pair of ball screw feed gears 62 being in the vicinity of the guide rails are arranged outside of the longitudinal sides of the faceplate 2*f* and extending in the longitudinal direction, that is, perpendicularly to the stripes 3*f* (hereinafter referred to as $x_3$-direction). Engaged with the pair of guide rails 65 and the pair of ball screw feed gears 62 are a guide rail 50 which is movable in the $x_3$-direction shown by an arrow, and a head 51 is mounted on the movable guide rail 50 to allow the movement of the head 51 in the direction of the stripes 3*f*, that is, in the $y_3$-direction shown by another arrow. The head 51 has three discharge tanks 52, 53 and 54 to allow simultaneous discharge of three kinds of phosphor material and a pen attachment 55 which includes the nozzle position detecting means and the nozzle assembly.

As will be explained later, the head 51 is moved on the faceplate 2 in the $y_3$-direction by a $y_3$-direction moving mechanism including $y_3$-direction motor 13*f*, the belting device and the movable guide rail 50 carrying the motor 13*f* and the belting device. The movable guide rail 50 is driven in the $x_3$-direction by driving the ball screw feed gear 62 by the $x_3$-direction motor 9*f*. Numeral 61 denotes a device (absolute shaft encoder) for detecting an absolute rotation angle of the ball screw feed gears 62. As shown in FIG. 10, in the coating apparatus for the flat faceplate, the panel (faceplate 2*f*) is located vertically downward of the pen attachment 55 which includes the nozzle assembly so that the effluent is discharged from the nozzle toward the faceplate 2*f* in the direction of the gravity.

Figure 11D:
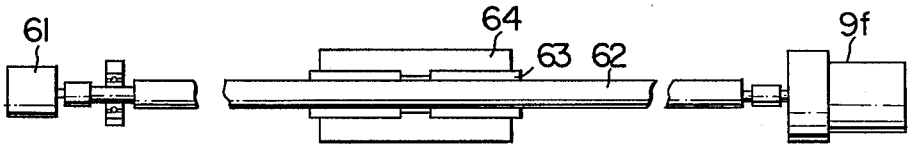
FIGS. 11A to 11E are partial enlarged views of the apparatus shown in FIG. 10.
Figure 11A:
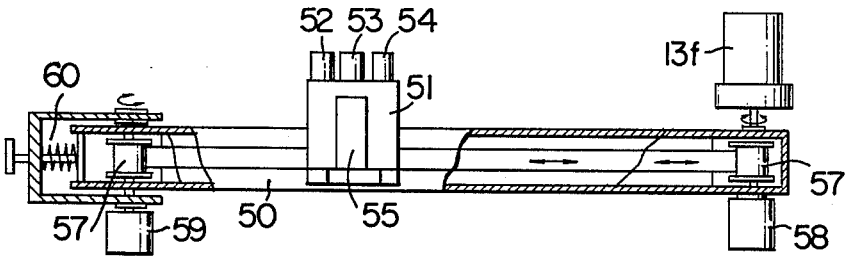
Figure 11B:
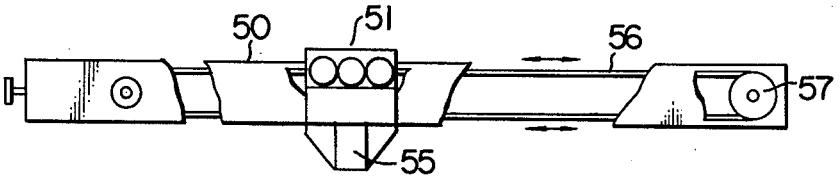
Figure 11C:
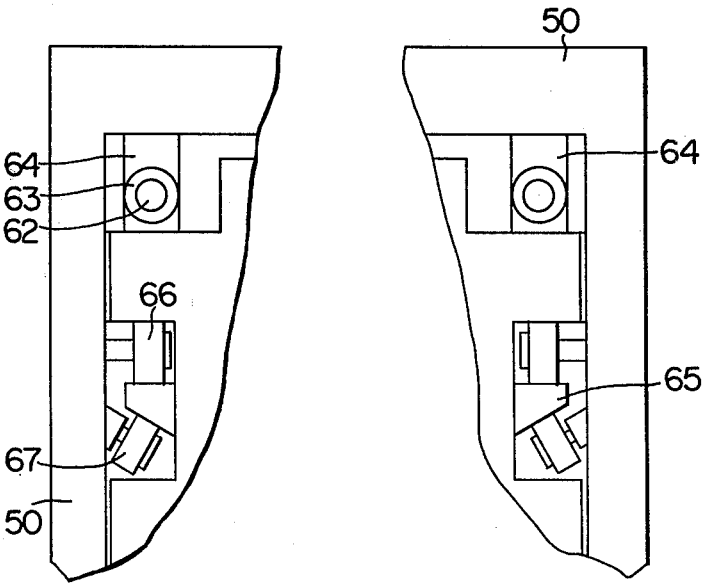
Figure 11E:
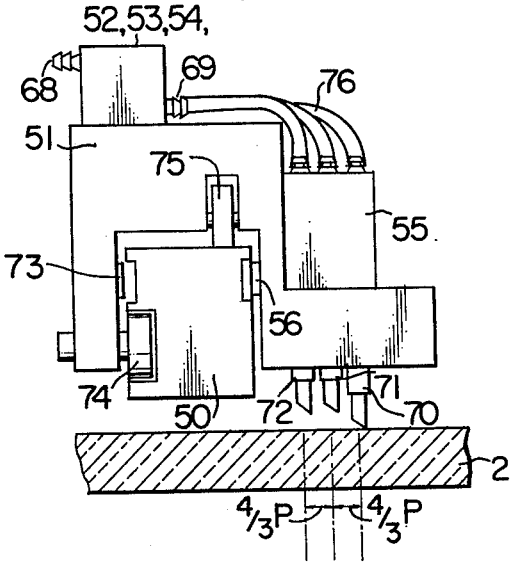

Referring to FIG. 11E, cartridge type phosphor discharge tanks 52, 53 and 54 for green, blue and red are attached to the head 51, and each tank has a pressure nozzle 68 at an upper portion thereof and a supply nozzle 69 at a lower portion. The G, B and R phosphor materials are supplied from the supply nozzles 69 to the nozzle assemblies 70, 71 and 72, which have similar constructions to that of the nozzle assembly N described above. The head 51 is fixed to a belting device at a portion 73 thereof, such as an index belt 56 (FIGS. 11A and 11B) which is movable around the length of the movable guide rail 50. A linear motion along the guide rail 50 is imparted to the head 51 through the belt 56. The head 51 is supported by the movable guide rail 50 through rotating bearings 74 and 75 in order to reduce frictional resistance.

FIGS. 11A and 11B mainly show the $y_3$-direction moving mechanism of the coating apparatus shown in FIG. 10. Index gear wheels 57 which are driven by the $y_3$-direction motor 13*f* are arranged at opposite ends of the movable guide rail 50, and the index belt 56 is movably spanned between the wheels 57. One of the wheels 57 has a velocity sensor 58 for sensing the rotating speed of the wheel and the other wheel 57 has an absolute angle sensor 59 for sensing a position of the index belt 56. A tension arm 60 is mounted at that end of the movable guide rail 50 at which the $y_3$-direction motor is not mounted to constantly impart a tension to the index belt 56 through the movable guide rail 50 to prevent the slip and slack of the belt. As shown, the absolute angle sensor 59 is coaxially mounted to the gear wheel 57 through the tension arm 60, and the other gear wheel 57 and the velocity sensor 58 are coaxially mounted to the $y_3$-direction motor 13*f*. By feeding back the signals from the velocity sensor 58 and the absolute angle sensor 59 to the $y_3$-direction motor 13*f* through the arrangement described above, the discharge tanks 52–54 and the head 51 having the pen attachment, which are fixed to the index belt 56, are capable of linear reciprocating movement converted from the rotational movement of the $y_3$-direction motor 13*f* by the index gear wheels 57 each having teeth of a constant pitch to enable constant pitch feed and by the index belt 56.

FIG. 11C and 11D show a portion of the $x_3$-direction moving mechanism of the coating apparatus shown in FIG. 10, in which a pair of fixed guide rails 65 bear the weights of the $y_3$-direction motor 13*f*, the head 51 and the movable guide rail 50 and serve to enhance the precision of drive in the $x_3$-direction of the faceplate. The pair of ball screw feed gears 62 arranged near the pair of fixed guide rails 65 are driven by a pair of $x_3$-direction motors 9*f* through ball screw nuts 63, which are set to the ball screw feed gears 62 in a manner to minimize backlash and fixed to nut casings 64. A screw rotation angle sensor 61 is attached to that end of the ball screw feed gear 62 at which the $x_3$-direction motor 9*f* is not mounted, to determine whether the rotation angle of each of the ball screws is correctly set in order to maintain the parallelism between the movable guide rail 50 and the faceplate 2*f*. In FIG. 11C, between the fixed guide rails 65 and the movable guide rail 50, bearing rollers 66 for preventing vertical ($z_3$-direction of the panel) vibration and meandering and bearing rollers 67 for preventing lateral ($y_3$-direction of the panel) vibration and meandering are arranged to constantly make contact with the fixed guide rails 65.

Again in FIG. 11E, the nozzle assemblies 70, 71 and 72 discharges B (blue), G (green) and R (red) phosphor materials, respectively. As explained in conjunction with FIG. 3C, the phosphor material is supplied from the tank to the nozzle under compressed condition in order to prevent the nozzle hole from being clogged, and a portion of the phosphor material is discharged from the end of the nozzle while the remainder is collected and recirculated. Spacings between adjacent nozzle ends are selected to be equal to 4/3 P (pitch) in the $x_3$-direction, where P is a spacing between the same kind of color phosphor stripes. In the illustrated embodiment, P is equal to 0.6 mm and a pitch between adjacent different color stripes is equal to 0.2 mm.

Figure 12:
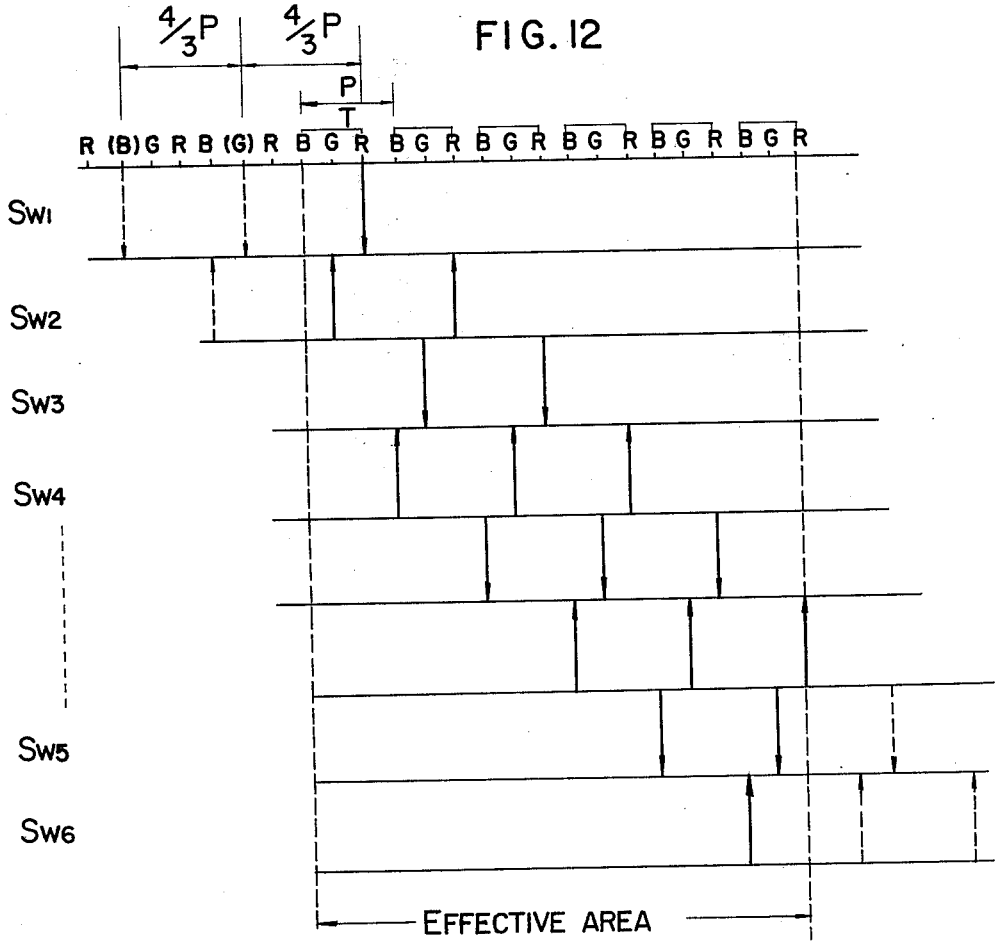
FIG. 12 is a chart for illustrating the operation of the coating apparatus shown in FIG. 10.

In a phosphor arrangement shown in FIG. 12, it is difficult to arrange nozzle heads each having hole diameter of 160–180 μm within a trio (T) of 200 μm width extending on both sides of the G stripe in the $x_3$-direction. Accordingly, the nozzle heads are arranged at an interval of 0.8 mm, that is 4/3 P, and the phosphor screen is drawn by repeating the following operation including the vertical movement of the nozzle assemblies and compression supply of air.

In the first $y_3$-direction sweep SW1, the B and G nozzle positions are beyond the effective area of the faceplate 2*f*. Therefore, the nozzles of the nozzle assemblies 72 and 71 are turned OFF and only the nozzle of the nozzle assembly 70 is turned ON. In the next $y_3$-direction sweep SW2, only the B nozzle position is beyond the effective area. Therefore, the nozzle of the nozzle assembly 72 is turned OFF while the nozzles of the nozzle assemblies 71 and 70 are turned ON. In the next $y_3$-direction sweep SW3 and the subsequent sweeps, all of the B, G and R nozzle positions are within the effective area and hence all of the nozzles of the nozzle assemblies 70–72 are turned ON. After most of the $y_3$-direction sweeps have been completed, in the $y_3$-direction swee SW5, the R nozzle position goes beyond the effective area, and in the $y_3$-direction sweep SW6, the R and B nozzle positions go beyond the effective area. Therefore, in those sweeps, the corresponding nozzles are turned OFF while the other nozzle is turned ON.

While the coating apparatus for the flat faceplate shown above has three nozzle assemblies to allow simultaneous application of three color phosphor materials in one sweep, it is apparent that only one nozzle assembly may be provided to sequentially apply three kinds of phosphor materials.

The coating apparatus for the cylindrical and flat faceplates shown in the embodiments of FIGS. 9A and 10 may be controlled by a modified one of the control system shown in FIG. 7, and such modification will be apparent to those who understood the teaching of the present invention.

We claim:

1. A method of manufacturing a striped phosphor screen for a black matrix type color picture tube, comprising the steps of:

forming a pattern of stripes of a light-absorbing material on the inner surface of a faceplate of a panel of an envelope to define transparent striped windows between the light-absorbing portions on the inner surface of said faceplate; and applying phosphor materials of different kinds on said striped windows on which said light-absorbing material does not lie by the use of a nozzle assembly having at least one nozzle; wherein said phosphor material applying step includes, (a) supplying said nozzle with a phosphor material, (b) controlling the position of said nozzle with respect to said faceplate while said nozzle is in motion with respect to said faceplate, the controlling including adjusting the nozzle position in a direction perpendicular to the length of said stripes in the plane of said faceplate and in a direction perpendicular to said faceplate, so that phosphor material will be properly applied to said striped windows, (c) causing said nozzle to sweep along a striped window while said nozzle discharges the phosphor material onto said striped windows, (d) causing said nozzle to move from one striped window to the next while said nozzle stops the discharge of the phosphor material each time sai nozzle finishes a complete sweep of one striped window, and (e) repeating the above steps (b)–(d) as many times as necessary to finish the sweep of the whole effective area of said faceplate by said nozzle.

2. A method according to claim 1, in which said faceplate is curved, and said sweep along the striped windows by said nozzle is effected by moving said nozzle along said striped windows with said curved faceplate kept stationary, and said movement of said nozzle from one striped window to the next is effected by moving said faceplate with said nozzle being kept stationary.

3. A method according to claim 2, in which said discharge of the phosphor material from said nozzle to said striped windows is effected in a direction against the gravitational force.

4. A method according to claim 1, in which said faceplate is flat, and both said sweep along the striped windows by said nozzle and said movement of said nozzle from one striped window to the next are effected by moving said nozzle with said flat faceplate kept stationary.

5. A method according to claim 4, in which said discharge of the phosphor material from said nozzle to said striped windows is effected in the direction of the gravitational force.

6. A method according to claim 1, further comprising the steps of applying a filming material only on the striped phosphor materials by the use of another nozzle assembly having a nozzle, said another nozzle assembly being capable of sweeping almost along the striped phosphor materials so that the applied filming material forms a covering in which striped discontinuity is formed along the light-absorbing pattern, forming a metal back layer on said covering of said filming material, and evaporating said filming material.

* * * * *